US011365075B2

(12) United States Patent
Kimura et al.

(10) Patent No.: US 11,365,075 B2
(45) Date of Patent: Jun. 21, 2022

(54) SHEET ACCOMMODATING APPARATUS, IMAGE FORMING SYSTEM, AND EXTENSION UNIT

(71) Applicant: FUJIFILM Business Innovation Corp., Tokyo (JP)

(72) Inventors: Yoshiki Kimura, Kanagawa (JP); Kiyoshi Watanabe, Kanagawa (JP); Shoichi Maeda, Kanagawa (JP); Masashi Ikeda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 112 days.

(21) Appl. No.: 16/868,545

(22) Filed: May 7, 2020

(65) Prior Publication Data

US 2021/0061594 A1 Mar. 4, 2021

(30) Foreign Application Priority Data

Sep. 2, 2019 (JP) ..... JP2019-159418

(51) Int. Cl.
*B65H 1/14* (2006.01)
*B65H 1/20* (2006.01)

(52) U.S. Cl.
CPC ..... *B65H 1/20* (2013.01); *B65H 1/14* (2013.01); *B65H 2405/1116* (2013.01)

(58) Field of Classification Search
CPC ..... B65H 2405/1116; B65H 1/20; B65H 1/14
See application file for complete search history.

(56) References Cited

U.S. PATENT DOCUMENTS

| | | | | |
|---|---|---|---|---|
| 9,359,157 | B2 * | 6/2016 | Niikura | B65H 3/48 |
| 10,494,207 | B2 * | 12/2019 | Niikura | B65H 1/14 |
| 10,549,936 | B2 * | 2/2020 | Shimura | B65H 1/28 |
| 10,577,204 | B2 * | 3/2020 | Yazawa | B65H 1/28 |
| 10,766,721 | B2 * | 9/2020 | Inoue | B65H 1/266 |
| 10,934,115 | B2 * | 3/2021 | Yazawa | B65H 7/04 |
| 2021/0039898 | A1 * | 2/2021 | Fujikura | B65H 1/266 |

FOREIGN PATENT DOCUMENTS

JP 2016000653 1/2016

* cited by examiner

*Primary Examiner* — Howard J Sanders
(74) *Attorney, Agent, or Firm* — JCIPRNET

(57) ABSTRACT

A sheet accommodating apparatus includes a loading portion onto which a sheet is loaded, a lifting and lowering unit that lifts and lowers the loading portion, a raising portion that raises a sheet loading surface with respect to a lowermost lowering position of the loading portion and above which a portion of the sheet is loaded, and an extension portion that extends to a position outward of the loading portion from the raising portion side as seen in plan view and supports another portion of the sheet.

19 Claims, 17 Drawing Sheets

SHEET ACCOMMODATING APPARATUS, IMAGE FORMING SYSTEM, AND EXTENSION UNIT

CROSS-REFERENCE TO RELATED APPLICATIONS

This application is based on and claims priority under 35 USC 119 from Japanese Patent Application No. 2019-159418 filed Sep. 2, 2019.

BACKGROUND

(i) Technical Field

The present invention relates to a sheet accommodating apparatus, an image forming system, and an extension unit.

(ii) Related Art

JP2016-000653A discloses a paper feeding device that is provided with a long-length option such that a tray bottom plate of a paper feeding tray is extended and a long-length sheet is installed. The paper feeding device is provided with a mechanism that locks the paper feeding tray such that the paper feeding tray becomes not able to be drawn out at the time of attachment of the long-length option and an extension plate is prevented from being damaged.

SUMMARY

Aspects of non-limiting embodiments of the present disclosure relate to a sheet accommodating apparatus in which a load on a lifting and lowering unit is reduced in comparison with a configuration in which a sheet loading surface is extended without being raised.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet accommodating apparatus includes a loading portion onto which a sheet is loaded, a lifting and lowering unit that lifts and lowers the loading portion, a raising portion that raises a sheet loading surface with respect to a lowermost lowering position of the loading portion and above which a portion of the sheet is loaded, and an extension portion that extends to a position outward of the loading portion from the raising portion side as seen in plan view and supports another portion of the sheet.

BRIEF DESCRIPTION OF THE DRAWINGS

Exemplary embodiment(s) of the present invention will be described in detail based on the following figures, wherein.

DETAILED DESCRIPTION

Figure 1:
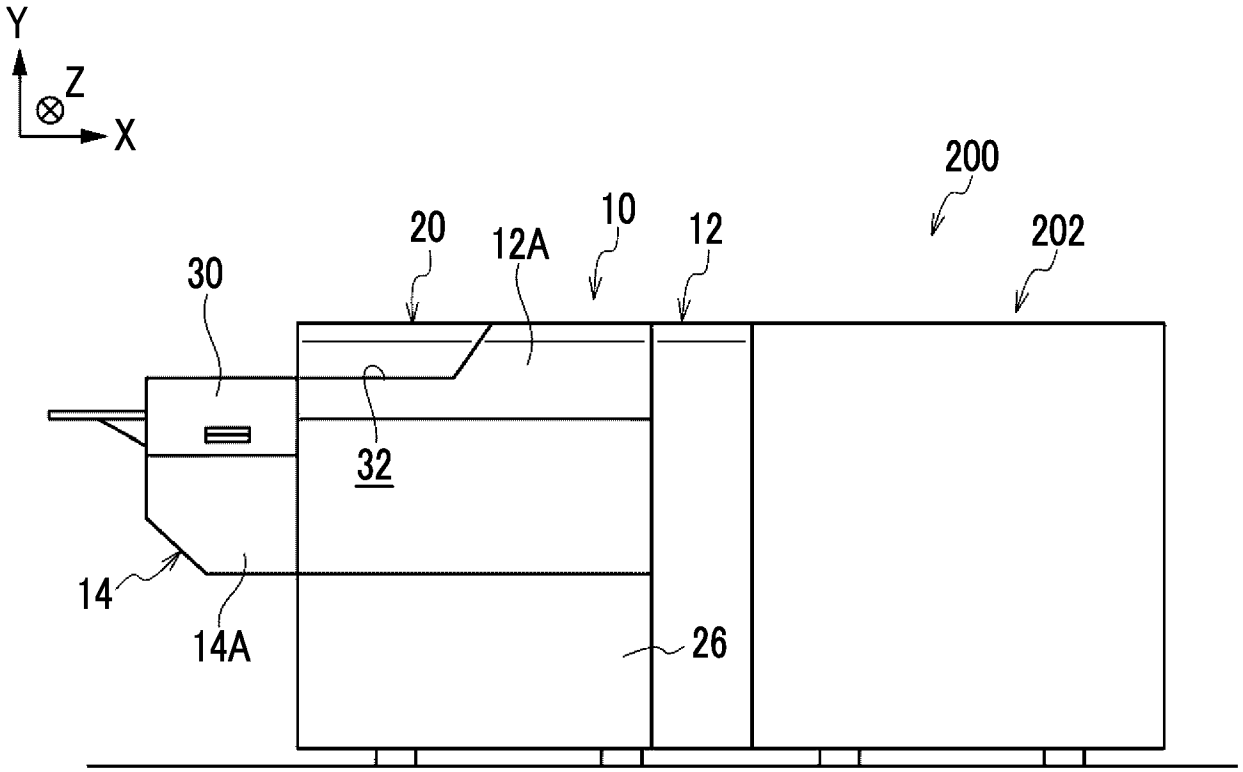
FIG. 1 is a front view showing an image forming system including a sheet accommodating apparatus according to a first exemplary embodiment.

Hereinafter, an exemplary embodiment of the present invention will be described. In the following description, a direction denoted by an arrow X in the drawing will be referred to as an apparatus width direction and a direction denoted by an arrow Y will be referred to as an apparatus height direction. In addition, a direction (direction along arrow Z) orthogonal to the apparatus width direction and the apparatus height direction will be referred to as an apparatus depth direction.

First Exemplary Embodiment

FIG. 1 shows a front view of an example of an image forming system 200 including a sheet accommodating apparatus 10 according to a first exemplary embodiment.

Configuration of Image Forming System

As shown in FIG. 1, the image forming system 200 includes an image forming apparatus 202 that forms an image on a recording medium which is an example of a sheet and the sheet accommodating apparatus 10 that supplies the recording medium to the image forming apparatus 202. The sheet accommodating apparatus 10 is disposed to be adjacent to a side portion of the image forming apparatus 202. Although not shown, in the image forming apparatus 202, an image forming unit that forms an image on a recording medium and a transporter that transports the recording medium to the image forming unit are provided. Various methods can be adopted as a recording method for the image forming unit. For example, an inkjet recording method, an electrophotographic recording method, a letterpress printing method, a lithographic printing method, an intaglio printing method, and the like can be adopted. The configurations and the arrangement of the image forming unit and the transporter are not particularly limited. The sheet accommodating apparatus 10 is attached to the image forming apparatus 202 as an option and is handled alone.

Configuration of Sheet Accommodating Apparatus

Overall Configuration

Figure 2:
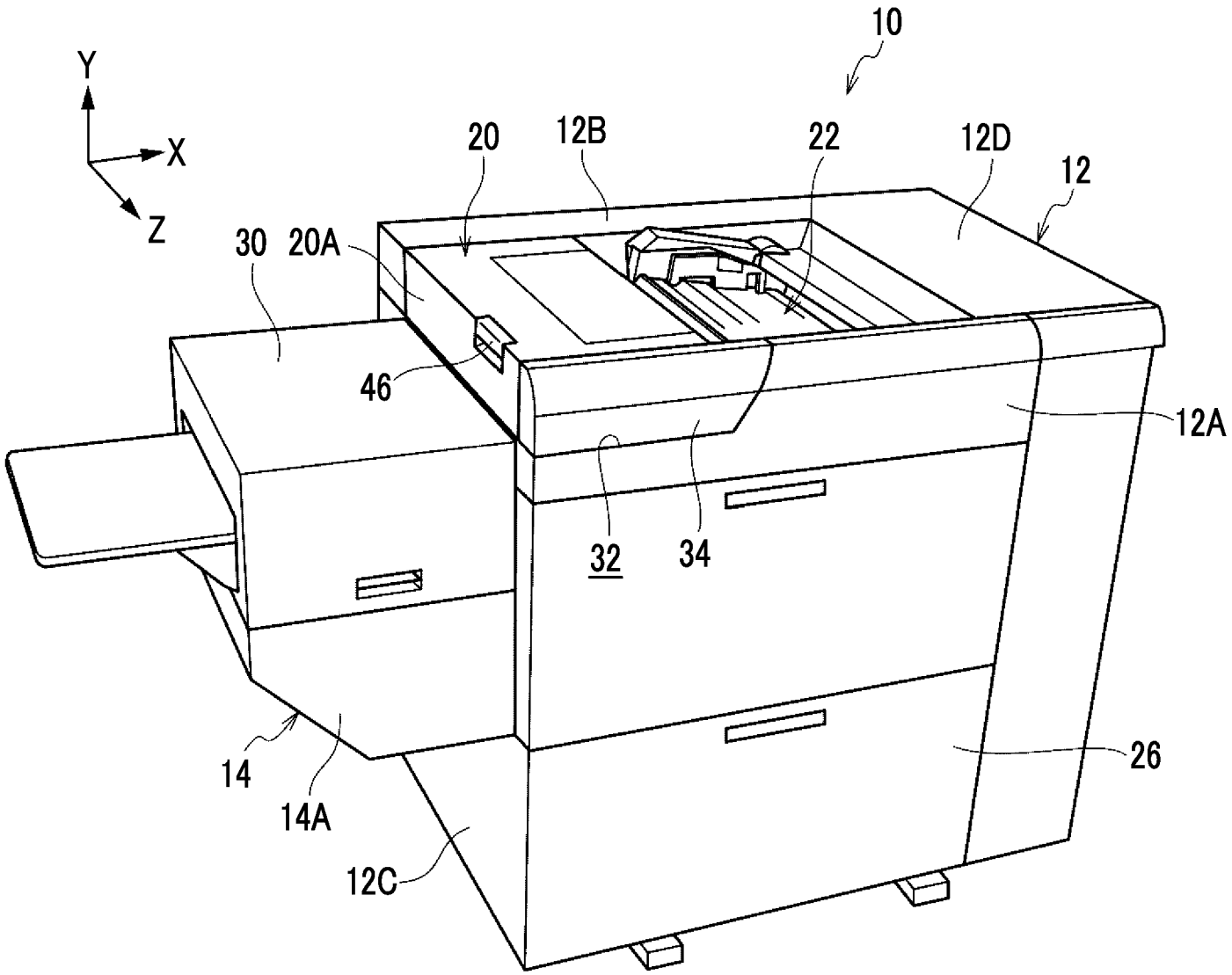
FIG. 2 is a perspective view showing the sheet accommodating apparatus according to the first exemplary embodiment.

FIG. 2 shows a perspective view of the sheet accommodating apparatus 10 according to the first exemplary embodiment. As shown in FIG. 2, the sheet accommodating apparatus 10 includes a main body portion 12 as an example of an apparatus main body and an attachment device 14 that is attached such that the attachment device 14 projects toward the outside of the main body portion 12 from a side portion of the main body portion 12. The attachment device 14 is configured to be additionally attached to the main body portion 12 as an option.

Figure 3:
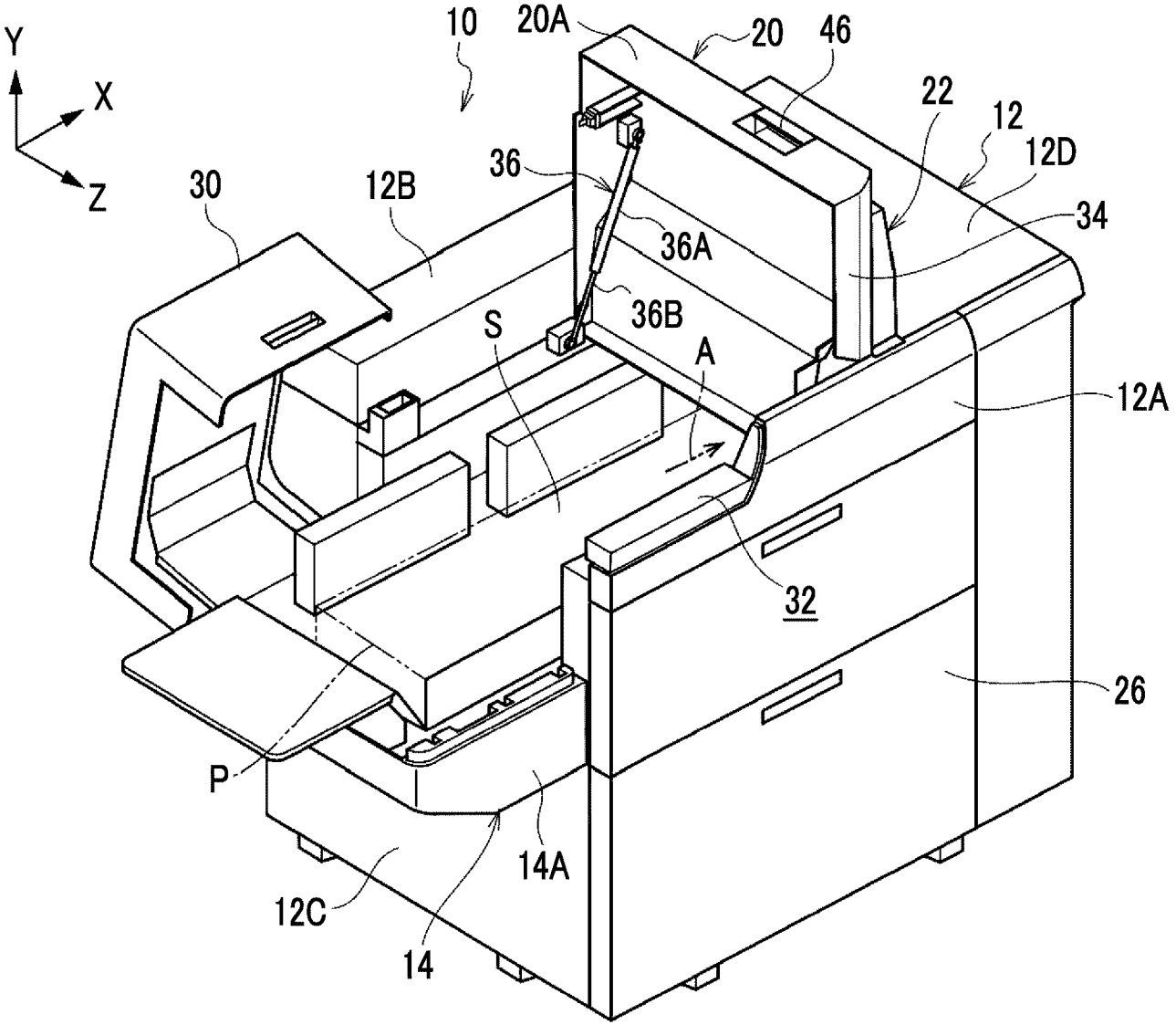
FIG. 3 is a perspective view showing a state where an opening and closing member used in the sheet accommodating apparatus according to the first exemplary embodiment is rotated such that a loading space on a loading portion is opened.

As shown in FIG. 3, in the main body portion 12, a loading space S is provided above a loading portion 16 (refer to FIG. 4) onto which a plurality of recording mediums P are loaded. In a case where the attachment device 14 is attached to the side portion of the main body portion 12, the recording medium P of which the length in a longitudinal direction is longer than the length in the longitudinal direction of the recording medium P that is loaded onto the loading portion 16 (refer to FIG. 4) in a case where only the main body portion 12 is provided, becomes able to be accommodated.

As shown in FIGS. 2 and 3, the sheet accommodating apparatus 10 includes an opening and closing member 20 that is provided at an upper portion of the main body portion 12 and opens and closes the loading space S in which the recording medium P is loaded and a damper 36 that assists an operation of opening the loading space S performed by the opening and closing member 20 (refer to FIG. 3). In addition, the sheet accommodating apparatus 10 includes a rotary member 22 that is disposed such that the opening and closing member 20 is overlaid with the rotary member 22. The rotary member 22 can rotate with respect to the main body portion 12 in accordance with the opening and closing of the opening and closing member 20. On an upper portion of the rotary member 22, a recording medium (not shown) for manual feeding is disposed. Ona portion of the attachment device 14 that projects from the side portion of the main body portion 12, an opening and closing cover 30 (which will be described later) that opens and closes the loading space S in which the recording medium P having a long length (which will be described later) is loaded is provided.

Furthermore, the sheet accommodating apparatus 10 includes a drawer tray 26 in which a different kind of recording medium (not shown) from the recording medium P is stored, the drawer tray 26 being disposed at a lower portion on a front side in the depth direction (that is, direction Z) of the main body portion 12. The drawer tray 26 is drawn from the main body portion 12 to store a different kind of recording medium (not shown) from the recording medium P.

Main Body Portion

As shown in FIGS. 2 and 3, the main body portion 12 has a function as a housing for parts of the sheet accommodating apparatus 10 other than the attachment device 14. The main body portion 12 includes a front wall 12A that is disposed on a front side in the apparatus depth direction (that is, direction Z) and a rear wall 12B that is disposed on a rear side in the apparatus depth direction. In addition, the main body portion 12 includes a side wall 12C that is disposed on one side in the apparatus width direction (that is, direction X) and a side wall (not shown in FIG. 2) that is disposed on the other side in the apparatus width direction. The front wall 12A is composed of a plurality of panels. The drawer tray 26 is provided in an area excluding an upper portion side of the front wall 12A and a portion of the front wall 12A that is on the other side in the apparatus width direction.

In addition, the main body portion 12 includes an upper wall 12D that is disposed above the front wall 12A, the rear wall 12B, the side wall 12C, and the other side wall (not shown in FIG. 2). The upper wall 12D is disposed only on the other side in the apparatus width direction. Upper ends of the front wall 12A and the rear wall 12B are connected to the upper wall 12D and a portion of the loading space S is covered by the upper wall 12D.

The front wall 12A and the rear wall 12B are configured such that the loading space S for the recording medium P is interposed between the front wall 12A and the rear wall 12B on opposite sides in a direction intersecting a transportation direction of the recording medium P, that is, the apparatus depth direction denoted by the arrow Z. In addition, the front wall 12A is provided with a cutout portion 32 obtained by making the height of a portion of the front wall 12A that is on a side opposite to the upper wall 12D lower than the height of a portion of the front wall 12A that is connected to the upper wall 12D.

Figure 4:
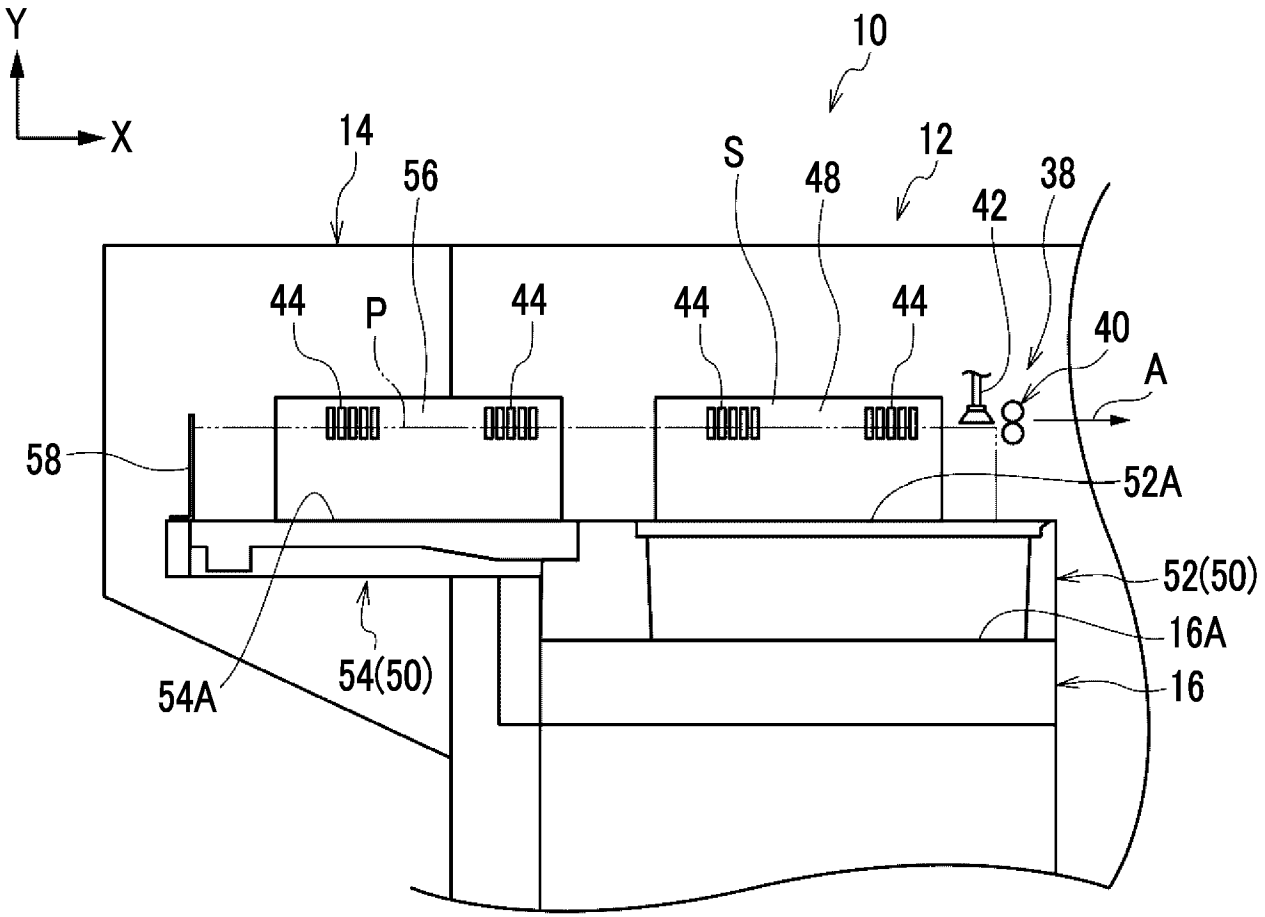
FIG. 4 is a sectional view showing schematic configurations of the loading portion, a raising portion, and an extension portion onto which a sheet is loaded in the sheet accommodating apparatus according to the first exemplary embodiment.

As shown in FIG. 4, the main body portion 12 includes the loading portion 16 onto which the recording medium P is loaded is provided. Although not shown, in a case where the attachment device 14 is not attached to the main body portion 12, the recording medium P having a normal size is directly loaded onto the loading portion 16 in the main body portion 12. As the recording medium P having a normal size, for example, the recording medium P having a length in a longitudinal direction up to 488 mm is used. A recording medium having a size of A3 or below corresponds to an example of the recording medium P having such a size.

The main body portion 12 is provided with a lifting and lowering device 100 (refer to FIG. 14) which is an example of a lifting and lowering unit that lifts and lowers the loading portion 16 in a vertical direction. The lifting and lowering device 100 is configured to lift the loading portion 16 such that the position of the uppermost recording medium P from among the recording mediums P loaded onto the loading portion 16 reaches a predetermined height. The configuration of the lifting and lowering device 100 will be described later.

In the main body portion 12, a transportation unit 38 that is disposed on the upper wall 12D side and transports the recording mediums P loaded onto the loading portion 16 one by one is provided. The transportation unit 38 includes a paper feeding roller 40 that feeds the uppermost recording medium P on the loading portion 16 and a suction unit 42 that is disposed inward of the paper feeding roller 40 in the apparatus width direction and sucks the uppermost recording medium P. Furthermore, the transportation unit 38 includes a plurality of air blowing units 44 disposed on a side wall 48 inside the main body portion 12. The plurality of air blowing units 44 are disposed to face upper portions of a plurality of the recording mediums P loaded onto the loading portion 16 and are configured to blow air to a space between the plurality of recording mediums P.

The paper feeding roller 40 is composed of a pair of rollers and feeds the recording medium P to the image forming apparatus 202 (refer to FIG. 1) side, that is, in a direction along an arrow A. The suction unit 42 is supported such that the suction unit 42 can move along the transportation direction of the recording medium P and supplies the recording medium P to a contact portion of the paper feeding roller 40 by moving to a downstream side in the transportation direction of the recording medium P with the recording medium P sucked thereto. The air blowing units 44 blow air to a space between a plurality of the recording mediums P such that the recording mediums P are restrained from being multi-fed by the paper feeding roller 40.

Opening and Closing Member

The opening and closing member 20 opens the loading space S for the recording medium P together with the opening and closing cover 30 in order that a plurality of the recording mediums P are disposed on the loading portion 16. As shown in FIGS. 2 and 3, the opening and closing member 20 is provided between an upper portion of the front wall 12A and an upper portion of the rear wall 12B. In the present exemplary embodiment, the opening and closing member 20 is provided at a position adjacent to the upper wall 12D of the main body portion 12.

The opening and closing member 20 is configured to open and close the loading space S (refer to FIG. 3) for the recording medium P by rotating around a hinge (not shown) provided on a downstream side in the transportation direction (that is, direction along arrow A shown in FIG. 3) of the recording medium P. The hinge is provided on an edge side of the upper wall 12D (refer to FIG. 2), which corresponds to one end side of the front wall 12A and one end side of the rear wall 12B in the apparatus width direction. The opening and closing member 20 covers an area from the upper wall 12D to end portions of the front wall 12A and the rear wall 12B on an upstream side in the transportation direction (that is, direction along arrow A shown in FIG. 3) of the recording medium P in a state where the loading space S is closed.

The opening and closing member 20 is provided with a projecting portion 34 that projects from an edge portion of the opening and closing member 20 and fills a gap between the cutout portion 32 and the edge portion of the opening and closing member 20 in a state where the loading space S is closed (refer to FIG. 2). The projecting portion 34 is provided on a tip end portion 20A side of the opening and closing member 20.

The damper 36 includes a tubular damper main body 36A and a rod 36B that is provided to be able to move forward and backward from the damper main body 36A. An end portion of the damper main body 36A that is on a side opposite to the rod 36B is rotatably supported by the opening and closing member 20. A tip end portion (that is, end portion on side opposite to damper main body 36A) of the rod 36B is rotatably supported by the rear wall 12B. The damper 36 is configured such that the rod 36B is pressed in a direction in which the rod 36B moves forward with respect to the damper main body 36A and in a case where the opening and closing member 20 is lifted halfway in a direction in which the loading space S is opened, the opening and closing member 20 is lifted up due to the action of the damper 36.

As shown in FIG. 2, the tip end portion 20A of the opening and closing member 20 is provided with a handle 46 used to release the opening and closing member 20 locked at the main body portion 12 in a state where the loading space S is closed by the opening and closing member 20. The handle 46 is configured to rotate in, for example, the vertical direction and is configured such that the opening and closing member 20 locked at the main body portion 12 by means of a latch mechanism (not shown) is released and the opening and closing member 20 becomes able to rotate in a direction in which the loading space S is opened in a case where the handle 46 is lifted up.

Attachment Device

The attachment device 14 has a function of accommodating the recording medium P having a long length, of which the length in the longitudinal direction is longer than the length of a recording medium of a normal size, while being attached to the side portion of the main body portion 12. As shown in FIGS. 2 and 3, the attachment device 14 projects to the outside of the main body portion 12 from an upper side of the side wall 12C of the main body portion 12. In the present exemplary embodiment, the attachment device 14 is disposed to be laid across a space between the front wall 12A and the rear wall 12B and a position outward of the side wall 12C. The attachment device 14 includes a main body portion 14A, which is a housing attached to the side wall 12C of the main body portion 12, and the opening and closing cover 30 provided on the main body portion 14A.

The opening and closing cover 30 is configured to rotate along the apparatus depth direction via a hinge (not shown) provided on a rear side of the main body portion 14A in the apparatus depth direction (that is, direction Z) (refer to FIG. 3). In a case where the opening and closing cover 30 is upwardly rotated toward the rear side from the front side in the apparatus depth direction (direction Z), a portion of the loading space S for the recording medium P having a long length is opened. In addition, the opening and closing cover 30 covers a portion of the attachment device 14 that projects from the front wall 12A and the rear wall 12B.

As shown in FIGS. 4 to 7, the attachment device 14 includes the first extension unit 50 that extends a loading surface for the recording medium P toward a position outward of the loading portion 16 in the apparatus width direction (that is, direction along arrow X) as seen in plan view. Here, the first extension unit 50 is an example of an extension unit. The first extension unit 50 includes a raising portion 52 that raises the loading surface for the recording medium P with respect to the lowermost lowering position of the loading portion 16 inside the main body portion 12 and an extension portion 54 that extends to a position outward of the loading portion 16 from the raising portion 52 side as seen in plan view.

The raising portion 52 is disposed on the loading portion 16 inside the main body portion 12 (refer to FIG. 4). In the present exemplary embodiment, the raising portion 52 is disposed on a loading surface 16A for the recording medium P of the loading portion 16. On an upper surface of the raising portion 52, a loading surface 52A onto which the recording medium P having a long length is loaded is formed.

The extension portion 54 is attached to a side portion of the raising portion 52 and is disposed to be laid across an area from the inside of the main body portion 12 to the inside of the main body portion 14A of the attachment device 14 (refer to FIG. 4). In other words, the extension portion 54 projects to the upstream side in the transportation direction (that is, direction along arrow A) of the recording medium P from a space between the front wall 12A and the rear wall 12B. In the sheet accommodating apparatus 10, an upper portion of the side wall 12C between the front wall 12A and the rear wall 12B is open to the upstream side in the transportation direction of the recording medium P and the extension portion 54 is disposed to be laid across the open portion. In the present exemplary embodiment, the apparatus width direction (that is, direction X) of the sheet accommodating apparatus 10 and the transportation direction of the recording medium P (that is, direction along arrow A) are the same as each other. On an upper surface of the extension portion 54, a loading surface 54A onto which the recording medium P having a long length is loaded is formed. The extension portion 54 is provided on one end side in a longitudinal direction (that is, length direction) of the recording medium P with respect to the raising portion 52.

Onto the loading surface 52A of the raising portion 52 and the loading surface 54A of the extension portion 54, the recording medium P having a long length is loaded. That is, one end portion side of the recording medium P in the longitudinal direction, which is a portion of the recording medium P, is supported on the raising portion 52 and the other end side of the recording medium P in the longitudinal direction, which is another portion of the recording medium P, is supported on the extension portion 54. An end guide 58 that restricts an end surface on the other end side in the longitudinal direction of the recording medium P is provided at an end portion of the extension portion 54 that is on the other end side in the longitudinal direction of the recording medium P, that is, on the upstream side in the transportation direction of the recording medium P. The end guide 58 is formed in, for example, an L-shape and one end portion thereof is supported on an upper surface of the loading surface 54A of the extension portion 54. In the present exemplary embodiment, the end guide 58 and the extension portion 54 are formed of metal and the end guide 58 is configured to adhere to the extension portion 54 by means of a magnetic force such that the end guide 58 becomes attachable to and detachable from the extension portion 54.

A distance (distance along apparatus width direction) from one end portion on the raising portion 52 side and the other end portion on the extension portion 54 side is larger than the length of the recording medium P having a size of A3 in the longitudinal direction. In the present exemplary embodiment, the distance (distance along apparatus width direction) from the one end portion on the raising portion 52 side and the other end portion on the extension portion 54 side is set to such a distance that a terminal of the recording medium P having a length of 864 mm does not stick out. As an example, the long recording medium P has a length in the longitudinal direction longer than 488 mm, and a recording medium P having a size of 864 mm or less can be stacked.

Opposite side walls 56 of the attachment device 14 in the apparatus depth direction (that is, direction along arrow Z) are provided with a plurality of the air blowing units 44 that blow air to an upper portion of the recording medium P loaded onto the extension portion 54.

As shown in FIGS. 6 to 11, the raising portion 52 includes a main body portion 70 attached to the loading surface 16A of the loading portion 16 and an upper wall portion 72 that is disposed above the main body portion 70 and serves as a loading surface for the recording medium P. The main body portion 70 includes, for example, a vertical wall portion 70A that is disposed on the downstream side in the transportation direction of the recording medium P and a pair of intermediate portions 70B connected to the vertical wall portion 70A. The vertical wall portion 70A is disposed along the apparatus depth direction (direction along arrow Z). The pair of intermediate portions 70B extend in a direction intersecting the vertical wall portion 70A from an intermediate portion of the vertical wall portion 70A in a longitudinal direction. In the present exemplary embodiment, the pair of intermediate portions 70B are disposed along the apparatus width direction (direction along arrow X). Furthermore, the main body portion 70 includes two wall portions 70C and 70D that are connected to the intermediate portions 70B at the upstream side in the transportation direction of the recording medium P and extend to opposite sides in the apparatus depth direction (refer to FIG. 11).

The upper wall portion 72 includes, for example, a center wall portion 72A fixed onto the pair of intermediate portions 70B, and a plurality of sliding plates 72B that are supported to be slidable in the apparatus depth direction from the center wall portion 72A.

The extension portion 54 is fixed to a side of the raising portion 52 by means of a fastening tool (not shown) and in a case where the loading portion 16 is lifted, the extension portion 54 is integrally lifted with the raising portion 52.

Figure 10:
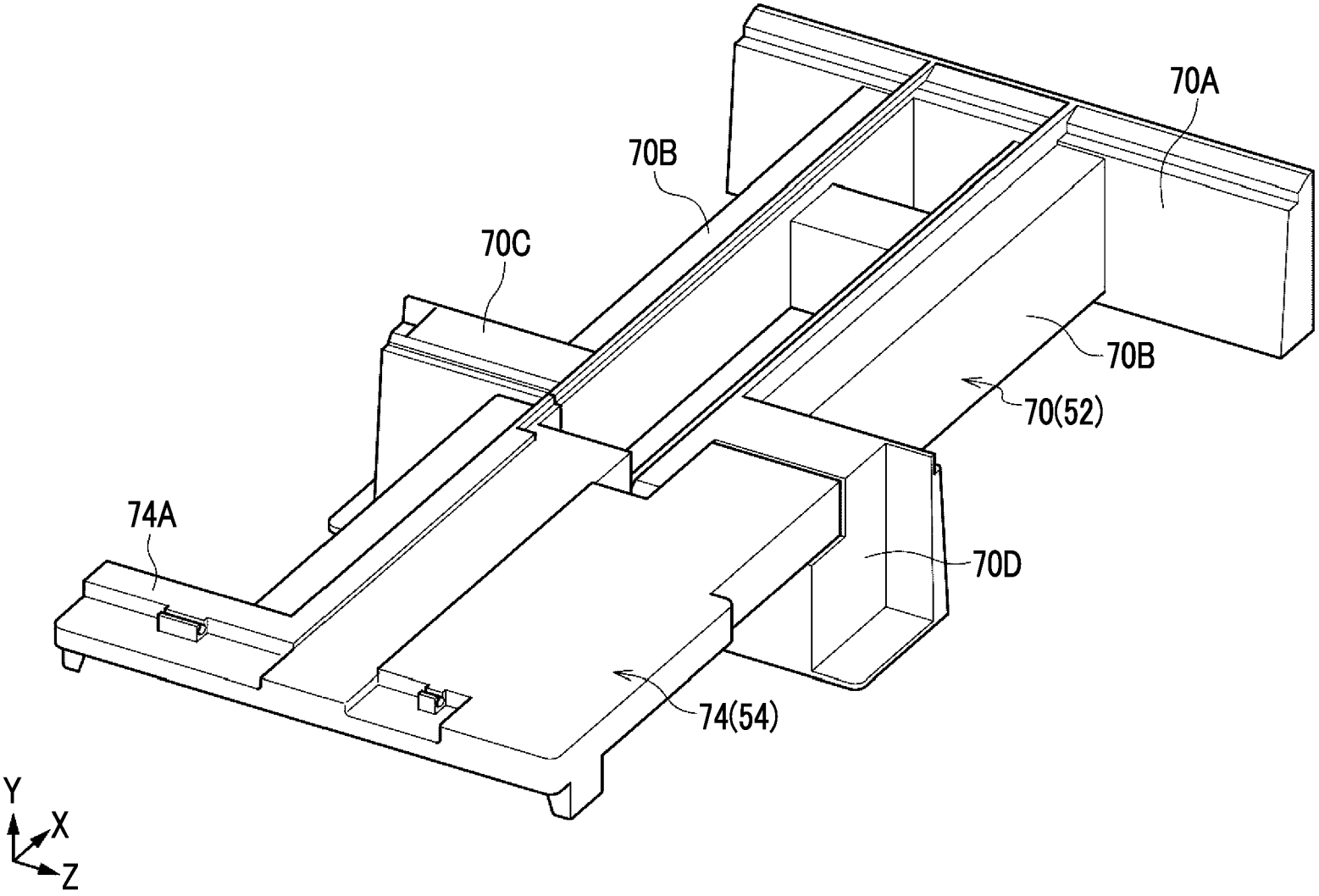
FIG. 10 is a perspective view partially showing the raising portion and the extension portion.
Figure 11:
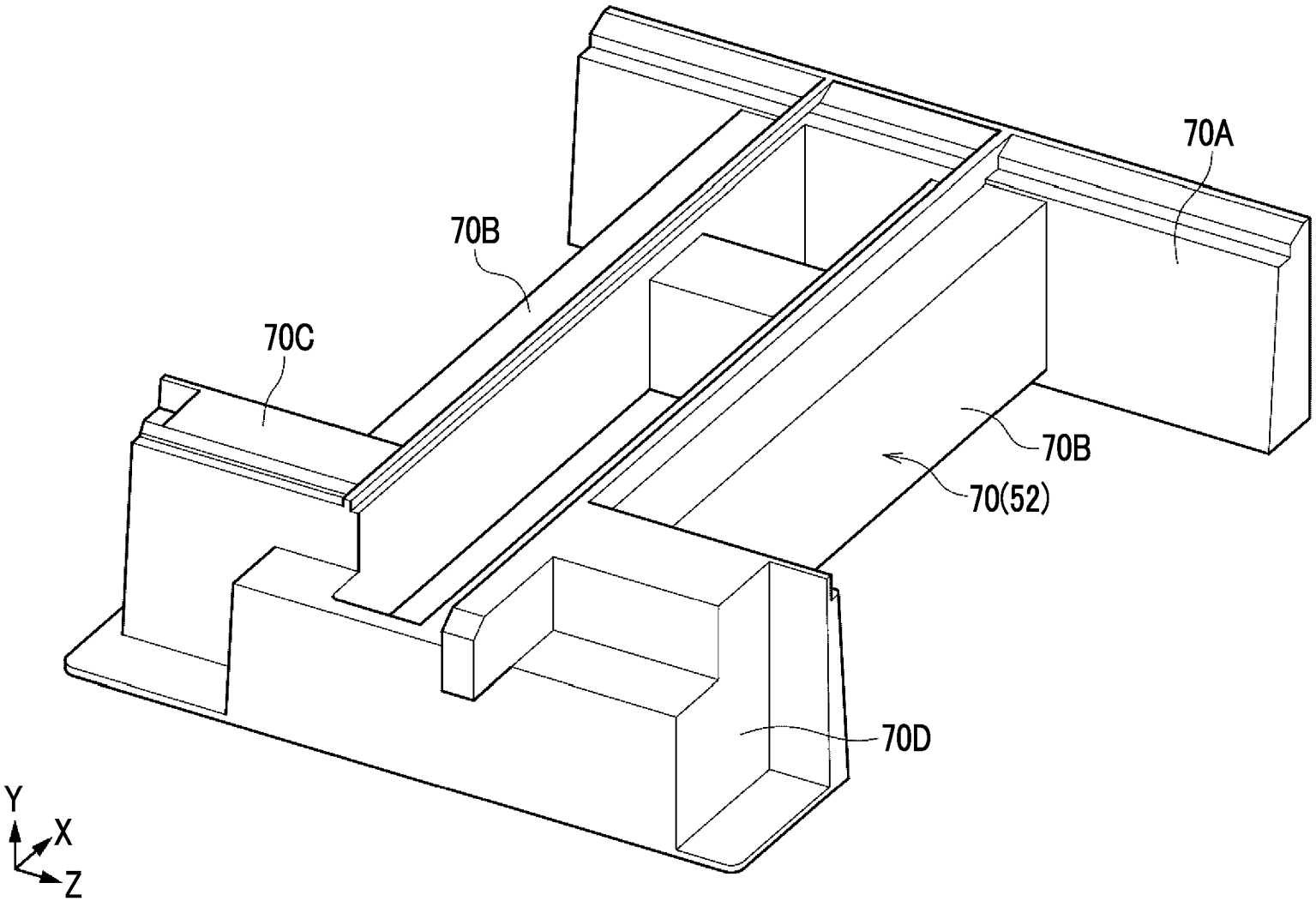
FIG. 11 is a perspective view showing the raising portion.
Figure 12:
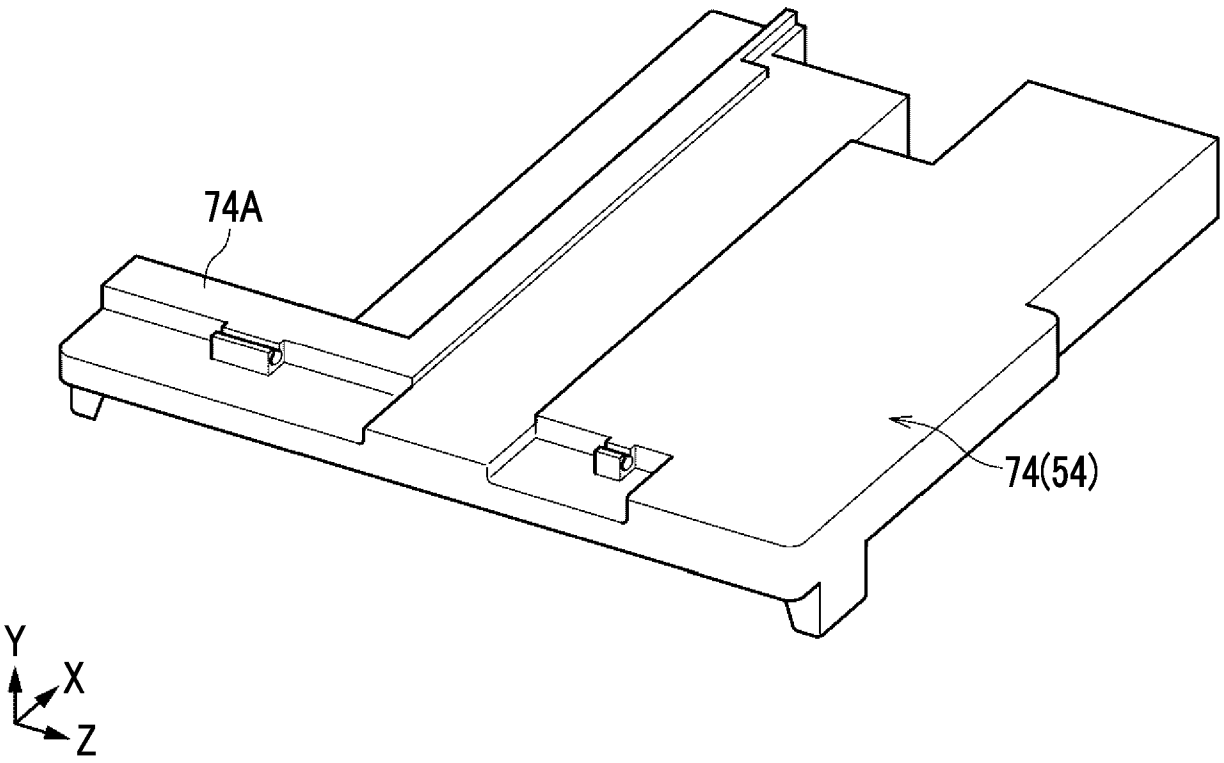
FIG. 12 is a perspective view showing the extension portion.

The extension portion 54 includes a fixation plate 74 that is connected to the intermediate portions 70B and the wall portion 70D of the main body portion 70 (refer to FIG. 10). The fixation plate 74 includes an extending portion 74A that extends in the apparatus depth direction at the upstream side in the transportation direction of the recording medium P. Furthermore, the extension portion 54 includes a plurality of sliding plates 76 that are slidable with respect to the fixation plate 74 in the apparatus depth direction (refer to FIG. 8). Opposite end portions of the plurality of sliding plates 76 in the apparatus width direction are supported by the wall portion 70C of the main body portion 70 and the extending portion 74A.

As shown in FIG. 4, in the sheet accommodating apparatus 10, air is blown to a space between a plurality of the recording mediums P loaded onto the raising portion 52 and the extension portion 54 from the air blowing units 44. Furthermore, the uppermost recording medium P is sucked by the suction unit 42 and the suction unit 42 moves toward the downstream side in the transportation direction of the recording medium P such that the recording medium P sucked by the suction unit 42 is fed by the paper feeding roller 40 in the direction along the arrow A.

Figure 5:
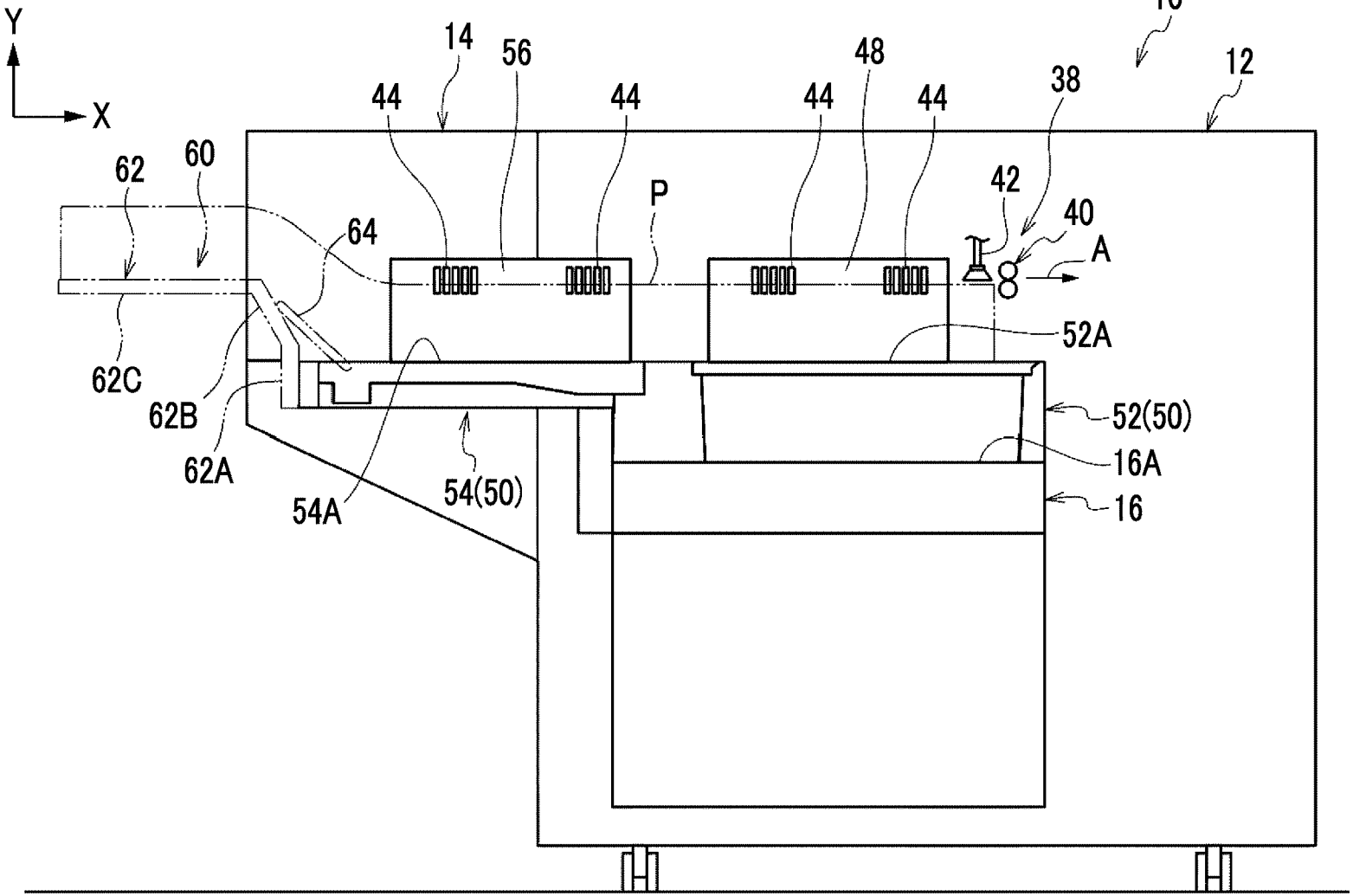
FIG. 5 is a sectional view showing a second extension unit that is attached to the loading portion, the raising portion, and the extension portion onto which a sheet is loaded in the sheet accommodating apparatus according to the first exemplary embodiment.
Figure 6:
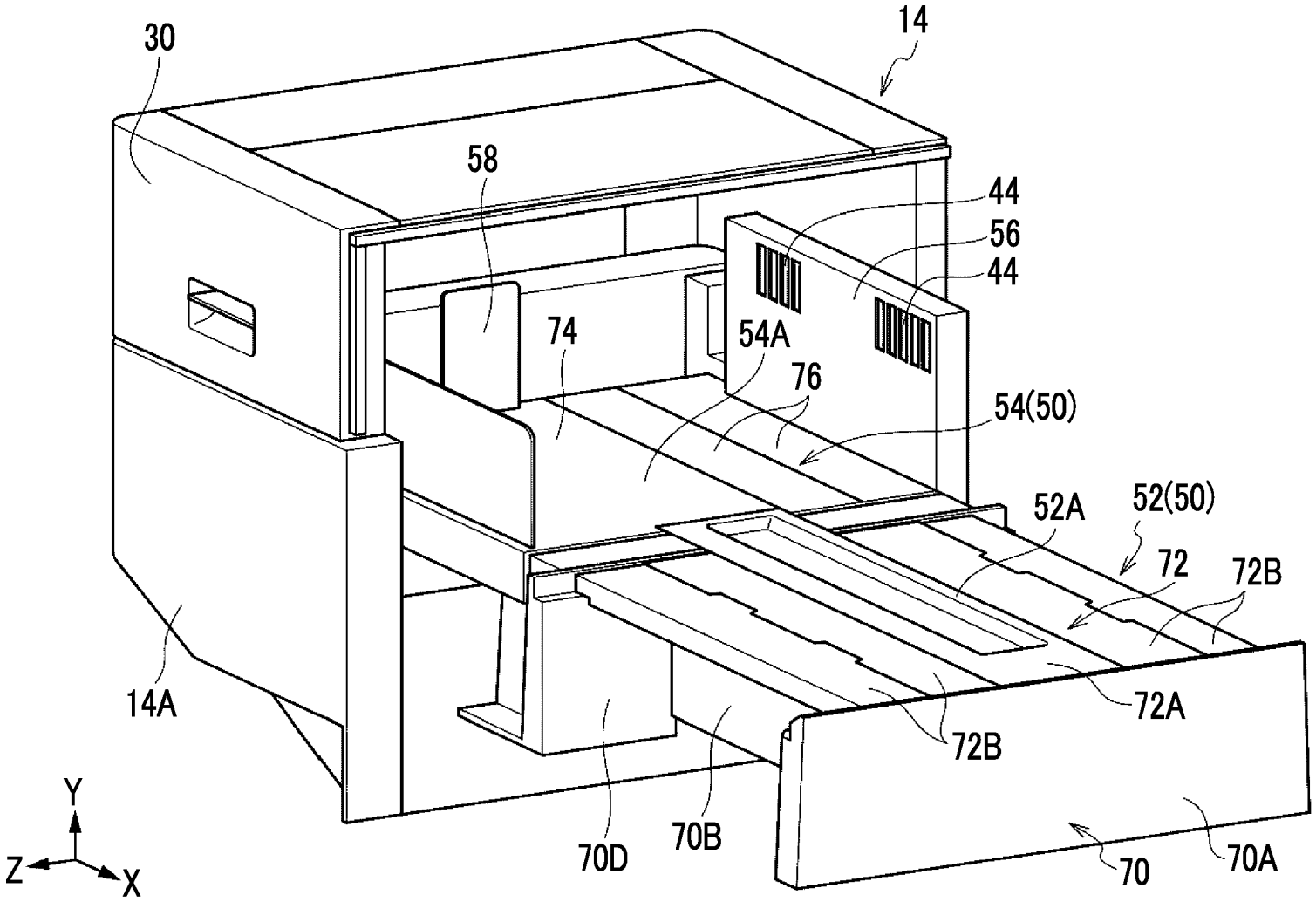
FIG. 6 is a perspective view showing the loading portion, the raising portion, and the extension portion, onto which a sheet is loaded in the sheet accommodating apparatus according to the first exemplary embodiment, with an opening and closing cover closed.
Figure 7:
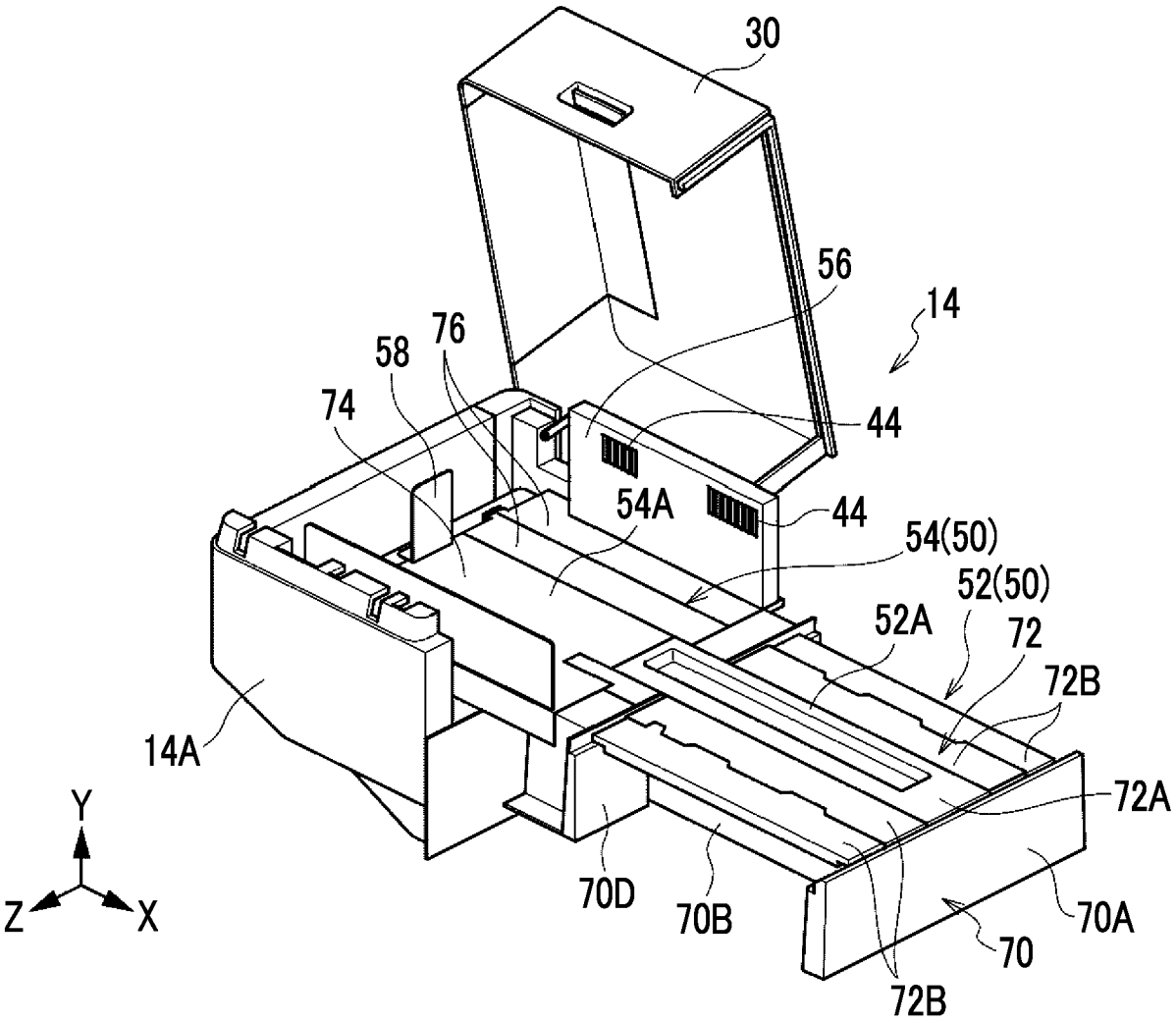
FIG. 7 is a perspective view showing the loading portion, the raising portion, and the extension portion, onto which a sheet is loaded in the sheet accommodating apparatus according to the first exemplary embodiment, with the opening and closing cover opened.
Figure 8:
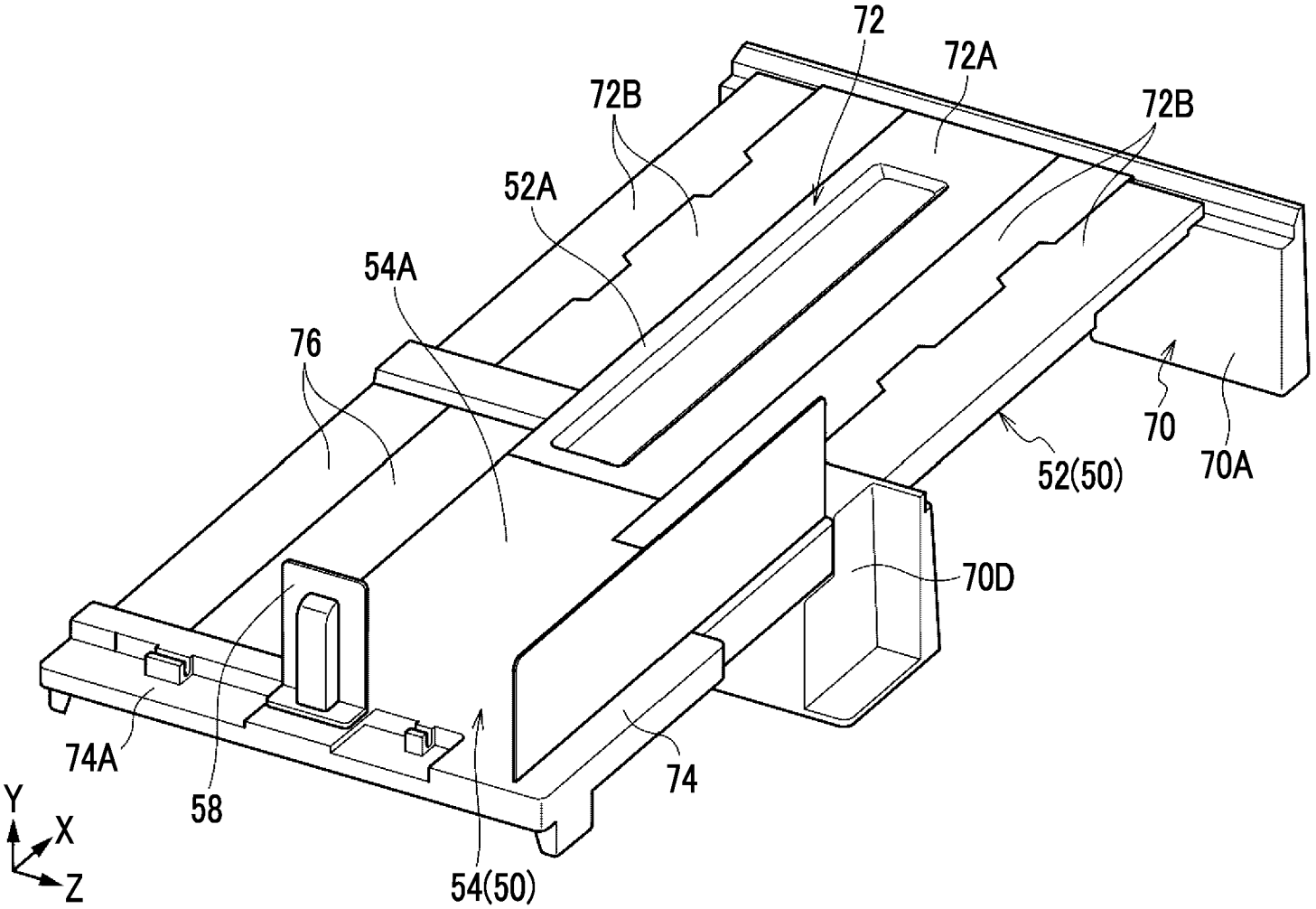
FIG. 8 is a perspective view showing the raising portion and the extension portion.
Figure 9:
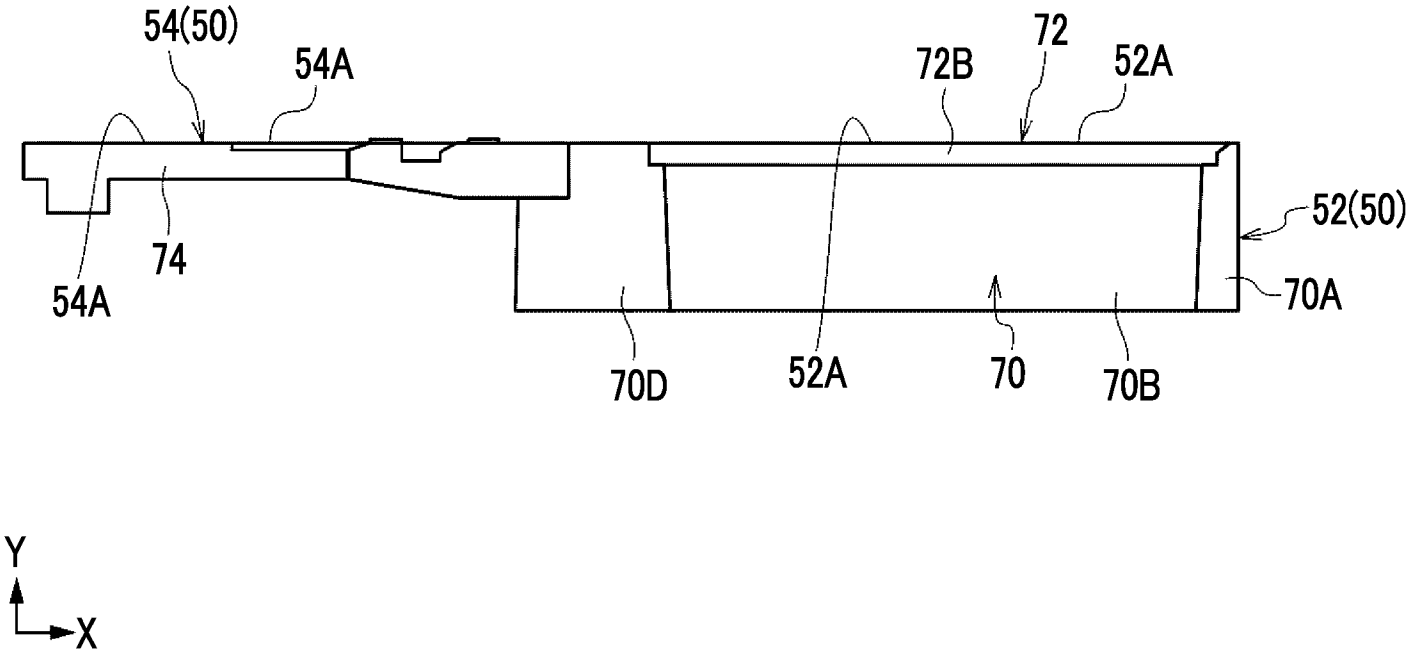
FIG. 9 is a side view showing the raising portion and the extension portion.

As shown in FIG. 5, on an end portion of the extension portion 54 that is on a side opposite to the raising portion 52, the second extension unit 60 that further extends the extension portion 54 is provided. The second extension unit 60 includes a first supporting portion 62 attached the end portion of the extension portion 54 that is on the side opposite to the raising portion 52 and a second supporting portion 64 that is suspended between the extension portion 54 and the first supporting portion 62 in an oblique direction.

The first supporting portion 62 includes a vertical wall portion 62A that is fixed to the end portion of the extension portion 54 that is on the side opposite to the raising portion 52, an inclined portion 62B extending in an oblique direction from an upper end of the vertical wall portion 62A, and a horizontal portion 62C extending in a horizontal direction from an upper end of the inclined portion 62B. The height of the horizontal portion 62C is greater than the height of the extension portion 54.

Regarding the second supporting portion 64, a lower end portion in the oblique direction is supported by the extension portion 54 and an upper end portion in the oblique direction is in contact with the inclined portion 62B. The second supporting portion 64 can slide against the inclined portion 62B as the extension portion 54 is lifted. Onto the raising portion 52, the extension portion 54, and the second extension unit 60, the recording medium P having a long length of which the length in the longitudinal direction is larger than 864 mm and equal to or smaller than 1200 mm is loaded, for example. At this time, one end portion side of the recording medium P in the longitudinal direction is disposed on the raising portion 52 and the other end portion side of the recording medium P in the longitudinal direction is disposed over the extension portion 54, the inclined portion 62B, and the horizontal portion 62C.

Lifting and Lowering Device

Figure 13:
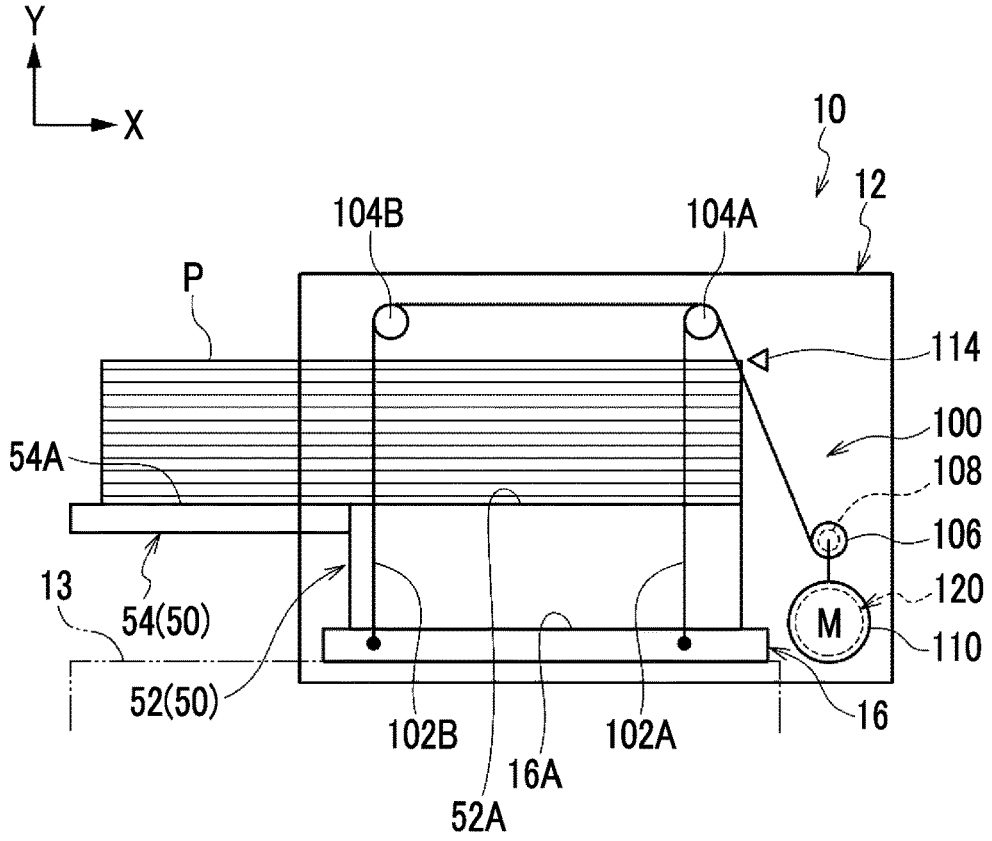
FIG. 13 is a side view showing a lifting and lowering device that lifts and lowers the loading portion, the raising portion, and the extension portion onto which a sheet is loaded in the sheet accommodating apparatus according to the first exemplary embodiment.
Figure 14:
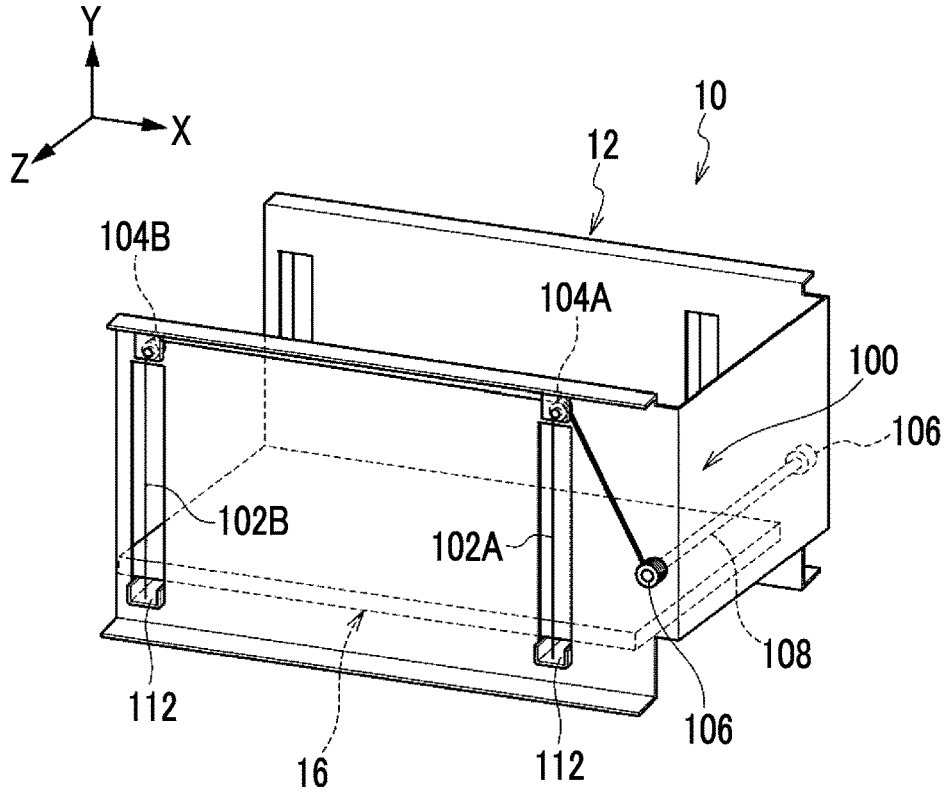
FIG. 14 is a perspective view showing the lifting and lowering device that lifts and lowers the loading portion, the raising portion, and the extension portion onto which a sheet is loaded in the sheet accommodating apparatus according to the first exemplary embodiment.

FIG. 13 shows a side view of the configuration of the lifting and lowering device 100. In addition, FIG. 14 shows a perspective view of the configuration of the lifting and lowering device 100. In FIG. 13, a schematic configuration is shown in order to make the configuration of the lifting and lowering device 100 easy to understand.

As shown in FIGS. 13 and 14, the lifting and lowering device 100 includes two wires 102A and 102B that are connected to a lower portion on one side in the depth direction of the loading portion 16 (in FIG. 14, front side in direction along arrow Z) and pulleys 104A and 104B that are disposed on an upper portion side of the main body portion 12 and on which the wires 102A and 102B are wound respectively. In addition, the lifting and lowering device 100 includes a winding-up pulley 106 with which the two wires 102A and 102B are wound up from the pulleys 104A and 104B (refer to FIG. 13).

Although not shown, the lifting and lowering device 100 also includes two wires 102A and 102B, the pulleys 104A and 104B, and the winding-up pulley 106 (shown in FIG. 14) on the other side in the depth direction of the loading portion 16 (in FIG. 14, rear side in direction along arrow Z). As shown in FIG. 14, the winding-up pulleys 106 on opposite sides in the apparatus depth direction are connected to each other by a pulley shaft 108. A motor 110 is connected to the winding-up pulleys 106 via a coupling mechanism 120 (refer to FIG. 15) which will be described later.

As shown in FIG. 14, two frames 112 are attached to a lower portion of the loading portion 16 along the apparatus depth direction (direction along arrow Z) and two wires 102A and 102B are connected to the frames 112 respectively. The wire 102A is disposed on the downstream side in the transportation direction of the recording medium P on the loading portion 16. The wire 102B is disposed on the upstream side in the transportation direction of the recording medium P on the loading portion 16.

As shown in FIG. 13, in the main body portion 12, the frame 13 that is disposed in a horizontal direction and comes into contact with the lower portion of the loading portion 16 when the loading portion 16 is lowered to the lowermost lowering position is provided. In a state where the loading portion 16 is lowered to the lowermost lowering position at which the loading portion 16 comes into contact with the frame 13, the raising portion 52 is disposed on the loading portion 16 and the extension portion 54 is attached to a side portion of the raising portion 52 that is on the upstream side in the transportation direction of the recording medium P.

As shown in FIG. 13, the lifting and lowering device 100 is provided with a sensor 114 that detects the position of the uppermost recording medium P from among recording mediums P loaded onto the loading portion 16 (in FIG. 13, onto raising portion 52 and extension portion 54). In the lifting and lowering device 100, the motor 110 is rotated based on a detection signal from the sensor 114 such that the loading portion 16 is lifted and the position of the uppermost recording medium P from among the recording mediums P reaches the predetermined height.

Figure 15:
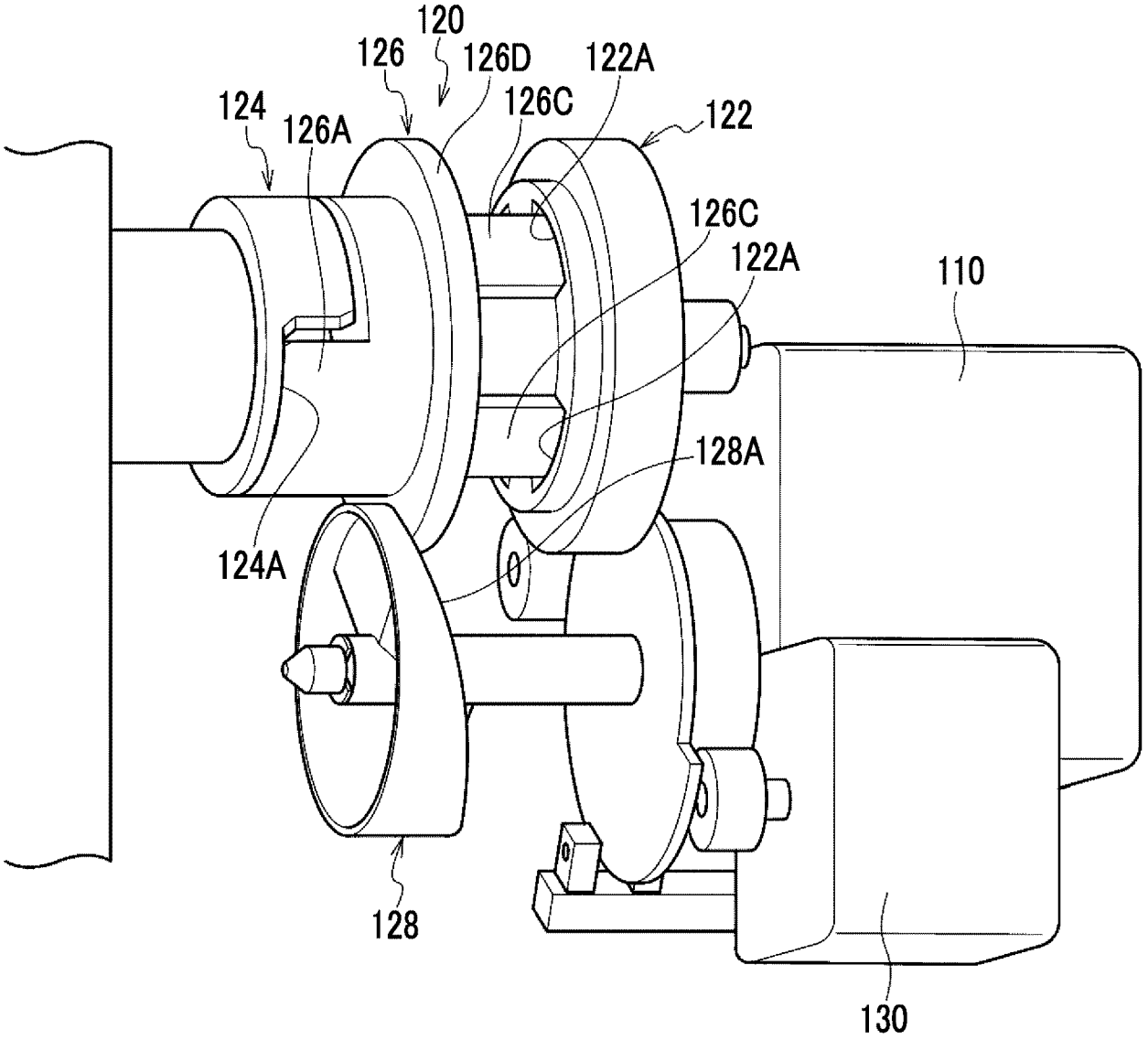
FIG. 15 is a perspective view showing a coupling mechanism used for the lifting and lowering device and a state where the loading portion and wires are coupled to each other.
Figure 16:
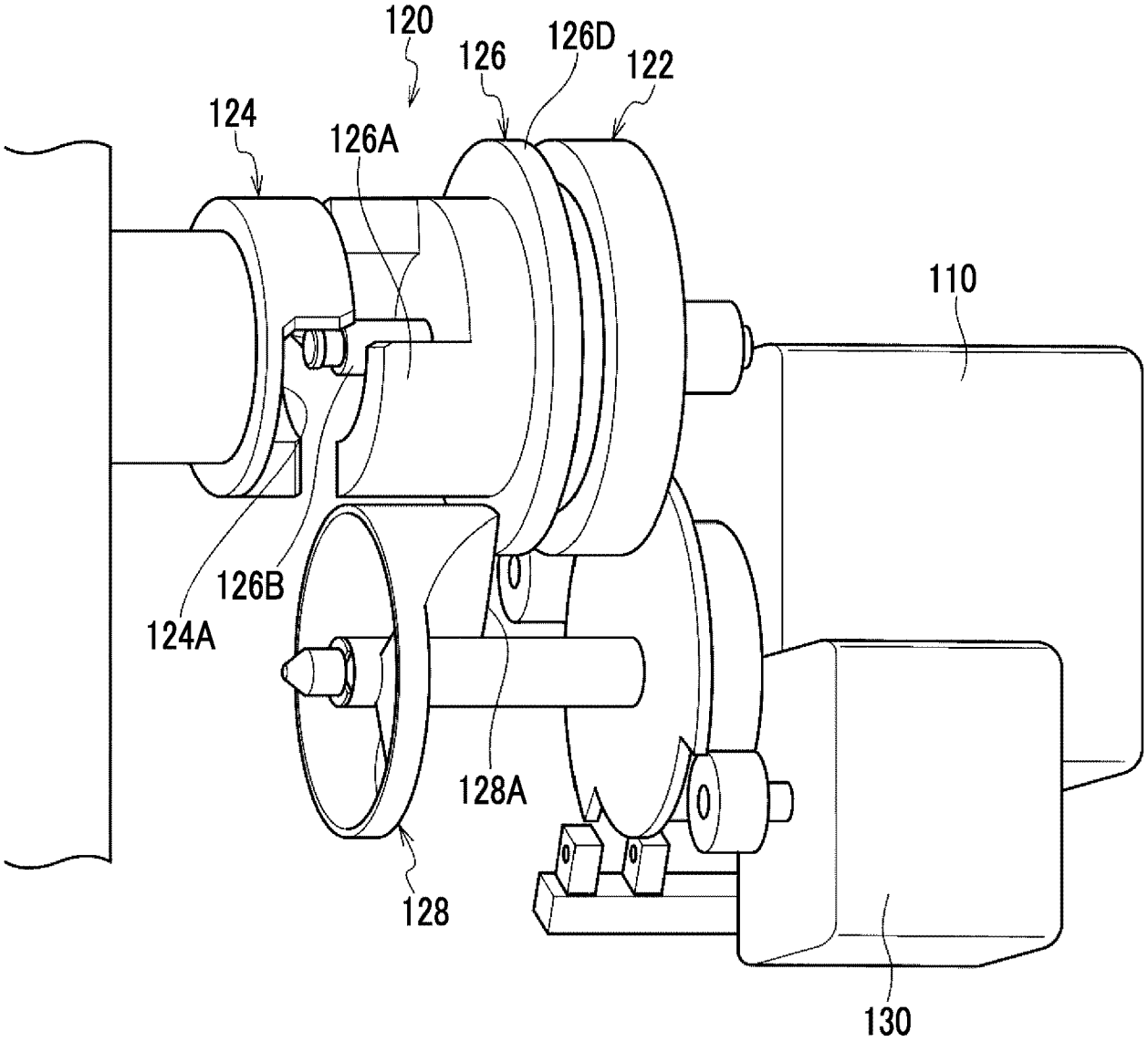
FIG. 16 is a perspective view showing the coupling mechanism used for the lifting and lowering device and a state where the loading portion and the wires are uncoupled to each other.

As shown in FIGS. 15 and 16, the coupling mechanism 120 includes a drive side coupling 122 connected to the motor 110 and a non-drive side coupling 124 connected to the pulley shaft 108 (refer to FIG. 14). In addition, the coupling mechanism 120 includes a spacer 126 that is disposed between the drive side coupling 122 and the non-drive side coupling 124, a cam 128 that moves the spacer 126 in an axial direction, and a motor 130 that rotates the cam 128.

The non-drive side coupling 124 includes a recess 124A on a side facing the spacer 126. The spacer 126 includes a projection portion 126A that protrudes toward the non-drive side coupling 124 side and engages with the recess 124A and a shaft portion 126B (refer to FIG. 16) connected to the non-drive side coupling 124. In a case where the spacer 126 is moved to the non-drive side coupling 124 side along the axial direction, the projection portion 126A engages with the recess 124A of the non-drive side coupling 124 and the shaft portion 126B (refer to FIG. 16) of the spacer 126 and the non-drive side coupling 124 are connected to each other.

The spacer 126 includes a plurality of projection portions 126C protruding toward the drive side coupling 122 side (refer to FIG. 15). The drive side coupling 122 includes hole portions 122A into which the plurality of projection portions 126C are respectively inserted when the spacer 126 moves toward the drive side coupling 122 side (refer to FIG. 15). When the spacer 126 moves toward the drive side coupling 122 side, the plurality of projection portions 126C are respectively inserted into the hole portions 122A such that the spacer 126 and the non-drive side coupling 124 are separated from each other and disconnected from each other.

The cam 128 includes a contact surface 128A that is in contact with a flange 126D of the spacer 126 and of which the thickness in the axial direction gradually changes. In a case where the contact surface 128A of the cam 128 rotates while being in contact with the flange 126D of the spacer 126, the spacer 126 moves to a connection position on the non-drive side coupling 124 side or a non-connection position on the drive side coupling 122 side.

Operation and Effect

Next, the operation and effect of the present exemplary embodiment will be described.

In the sheet accommodating apparatus 10, in a case where the recording medium P having a long length of which the length in the longitudinal direction is longer than the length of a recording medium of a normal size (for example, recording medium P of which length is up to 864 mm) is used, the attachment device 14 is attached to the main body portion 12. In a case where the first extension unit 50 of the attachment device 14 is to be attached, the cam 128 of the coupling mechanism 120 is rotated such that the coupling mechanism 120 enters a non-connected state (refer to FIG. 16). Accordingly, the wires 102A and 102B of the lifting and lowering device 100 and the motor 110 are disconnected from each other and thus the loading portion 16 is lowered to the lowermost lowering position, at which the loading portion 16 comes into contact with the frame 13, due to the weight thereof (refer to FIG. 13).

In this state, the raising portion 52 is attached onto the loading portion 16 by means of a fastening tool (not shown) and the extension portion 54 is attached to a side portion of the raising portion 52 that is on an upper side in the vertical direction by means of a fastening tool (not shown). Furthermore, the recording medium P having a long length (for example, recording medium P of which length is up to 864 mm) is loaded onto the raising portion 52 and the extension portion 54. In addition, the cam 128 of the coupling mechanism 120 is rotated such that the coupling mechanism 120 enters a connected state (refer to FIG. 15).

In the lifting and lowering device 100, in a state where the coupling mechanism 120 is connected, a rotational force of the motor 110 is transmitted to the winding-up pulleys 106 via the coupling mechanism 120 such that the winding-up pulleys 106 are rotated. Accordingly, the wires 102A and 102B are wound up and the loading portion 16 connected to the wires 102A and 102B is lifted via the pulleys 104A and 104B. At this time, the raising portion 52 of the loading portion 16 and the extension portion 54 that is attached to the side portion of the raising portion 52 that is on the upper side in the vertical direction are integrally lifted with the loading portion 16. In the lifting and lowering device 100, the loading portion 16 is lifted such that the position of the uppermost recording medium P from among the recording mediums P loaded onto the raising portion 52 and the extension portion 54 reaches the predetermined height (refer to FIG. 4). In this state, in the sheet accommodating apparatus 10, the recording mediums P are supplied to the image forming apparatus 202 by the transportation unit 38 one by one.

Here, sheet accommodating apparatuses in first to third comparative examples will be described with reference to FIGS. 18 to 20.

Figure 18:
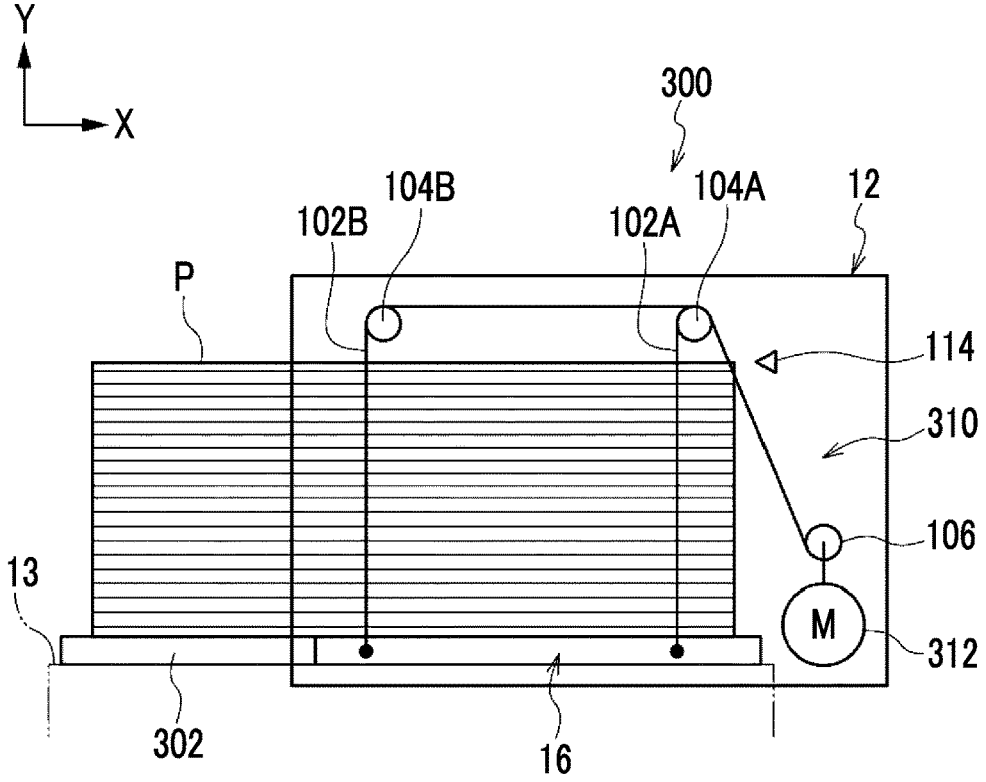
FIG. 18 is a side view showing a lifting and lowering device that lifts and lowers a loading portion and an extension portion onto which a sheet is loaded in a sheet accommodating apparatus according to a first comparative example.

FIG. 18 shows a sheet accommodating apparatus 300 in the first comparative example. As shown in FIG. 18, the sheet accommodating apparatus 300 includes the loading portion 16 and an extension portion 302 that is attached to a side portion of the loading portion 16 that is on the upstream side in the transportation direction of the recording medium P. The extension portion 302 is fixed to the loading portion 16 by means of a fastening tool (not shown). In addition, the sheet accommodating apparatus 300 includes a lifting and lowering device 310 that lifts and lowers the loading portion 16.

The lifting and lowering device 310 includes the two wires 102A and 102B that are connected to the loading portion 16 and the pulleys 104A and 104B that are disposed on an upper portion side of the main body portion 12 and on which the wires 102A and 102B are wound respectively. In addition, the lifting and lowering device 310 includes the winding-up pulley 106 with which the two wires 102A and 102B are wound up from the pulleys 104A and 104B. A motor 312 is connected to the winding-up pulley 106.

In the sheet accommodating apparatus 300, the recording medium P having a long length is loaded onto the loading portion 16 and the extension portion 302. In the lifting and lowering device 310, the position of the uppermost recording medium P is detected by the sensor 114 and thus the loading portion 16 is lifted such that the position of the uppermost recording medium P reaches a predetermined height.

However, in the sheet accommodating apparatus 300, since the recording mediums P having a long length are loaded onto the loading portion 16 and the extension portion 302, the mass of the recording mediums P is large. Therefore, in the case of the sheet accommodating apparatus 300, it is necessary to change a motor to the motor 312 that can lift a heavier recording medium P than the motor 110 of the sheet accommodating apparatus 10 in the present exemplary embodiment. In addition, a balance in the apparatus width direction is poor when the recording medium P having a long length is lifted up by the loading portion 16 and the extension portion 302 and thus there is a possibility that it becomes difficult to lift up the recording medium P having a long length.

Figure 19:
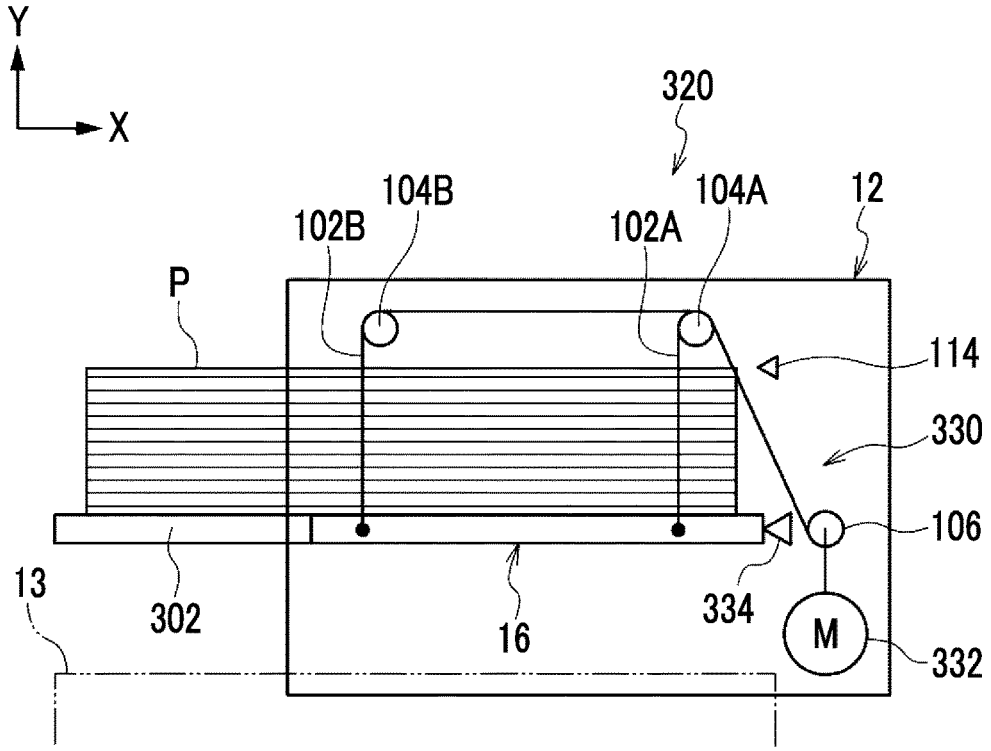
FIG. 19 is a side view showing a lifting and lowering device that lifts and lowers a loading portion and an extension portion onto which a sheet is loaded in a sheet accommodating apparatus according to a second comparative example.

FIG. 19 shows a sheet accommodating apparatus 320 in the second comparative example. As shown in FIG. 19, the sheet accommodating apparatus 320 includes the loading portion 16 and the extension portion 302 that is attached to a side portion of the loading portion 16 that is on the upstream side in the transportation direction of the recording medium P. In addition, the sheet accommodating apparatus 320 includes a lifting and lowering device 330 that lifts and lowers the loading portion 16.

The lifting and lowering device 330 includes the two wires 102A and 102B that are connected to the loading portion 16, the pulleys 104A and 104B on which the two wires 102A and 102B are wound respectively, and the winding-up pulley 106 with which the two wires 102A and 102B are wound up. Furthermore, the lifting and lowering device 330 includes a motor 332 connected to the winding-up pulley 106 and a sensor 334 that measures the height of the loading portion 16 at the time of attachment of the extension portion 302.

In the sheet accommodating apparatus 320, the sensor 334 measures the height of the loading portion 16, the loading portion 16 is prevented from being lowered to the lowermost lowering position at which the loading portion 16 comes into contact with the frame 13, and the number of long-length recording mediums P loaded onto the loading portion 16 and the extension portion 302 is limited.

However, in the case of the sheet accommodating apparatus 320, the sensor 334 is required and it is necessary to change a detection circuit (not shown). In addition, in a case where the recording medium P is loaded in a state where the loading portion 16 and the extension portion 302 are suspended in midair, a large load attributable to an impact on the loading portion 16 or the extension portion 302 is applied to the wires 102A and 104B or a drive transmission system of the motor 332.

Figure 20:
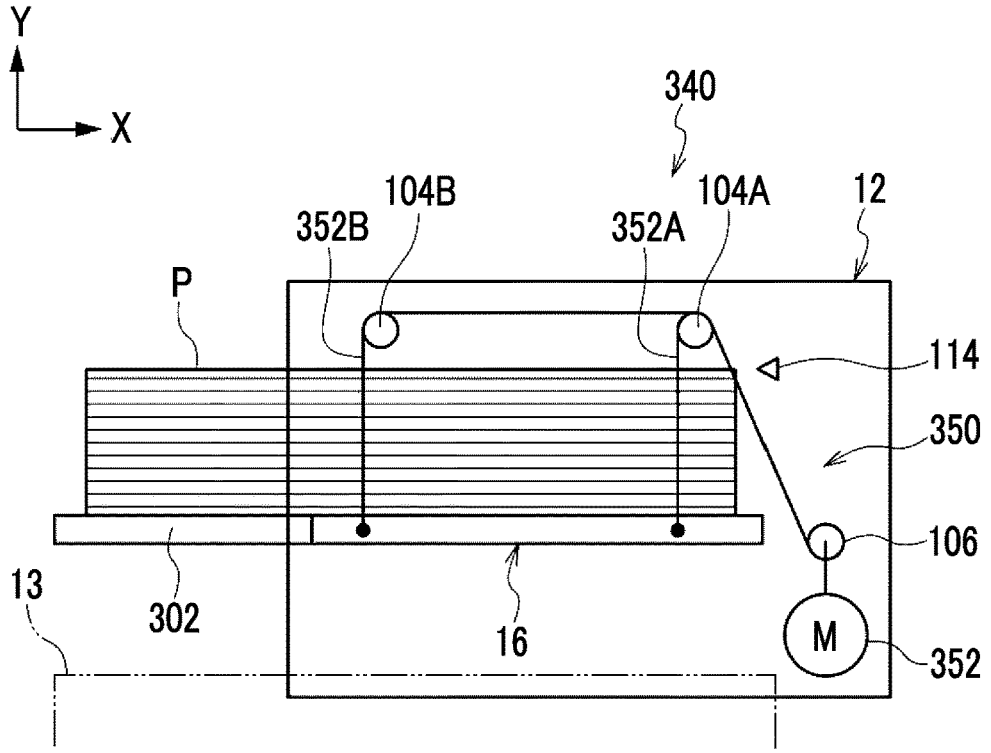
FIG. 20 is a side view showing a lifting and lowering device that lifts and lowers a loading portion and an extension portion onto which a sheet is loaded in a sheet accommodating apparatus according to a third comparative example.

FIG. 20 shows a sheet accommodating apparatus 340 in the third comparative example. As shown in FIG. 20, the sheet accommodating apparatus 340 includes the loading portion 16 and the extension portion 302 that is attached to a side portion of the loading portion 16 that is on the upstream side in the transportation direction of the recording medium P. In addition, the sheet accommodating apparatus 340 includes a lifting and lowering device 350 that lifts and lowers the loading portion 16.

The lifting and lowering device 350 includes two wires 352A and 352B that are connected to the loading portion 16, the pulleys 104A and 104B on which the two wires 352A and 352B are wound respectively, and the winding-up pulley 106 with which the two wires 352A and 352B are wound up. Furthermore, the lifting and lowering device 350 includes a motor 352 connected to the winding-up pulley 106. The length of the wire 352A is smaller than the length of the wire 102A of the sheet accommodating apparatus 320 in the second comparative example and the length of the wire 352B is smaller than the length of the wire 102B of the sheet accommodating apparatus 320 in the second comparative example. In the sheet accommodating apparatus 340, a sensor (sensor 334 shown in FIG. 19) that measures the height of the loading portion 16 is not provided.

In the sheet accommodating apparatus 340, the lengths of the wires 352A and 352B are made smaller than the lengths of the wires 102A and 102B of the sheet accommodating apparatus 320 in the second comparative example in order that a sensor that measures the height of the loading portion 16 is not provided. However, in the case of the sheet accommodating apparatus 340, it is necessary to replace the wires 352A and 352B to accommodate the recording medium P having a long length. In addition, in a case where the recording medium P is loaded in a state where the loading portion 16 and the extension portion 302 are suspended in midair, a large load is applied to the wires 352A and 352B.

However, in the sheet accommodating apparatus 10 in the present exemplary embodiment, the raising portion 52 is disposed on the loading portion 16 and the extension portion 54 is attached to a side portion of the raising portion 52 with the loading portion 16 lowered to the lowermost lowering position, at which the loading portion 16 comes into contact with the frame 13, due to the weight thereof. Therefore, in the sheet accommodating apparatus 10, the recording mediums P having a long length are loaded onto the raising portion 52 and the extension portion 54 and the mass of the recording mediums P having a long length is small. In addition, in the sheet accommodating apparatus 10, it is not necessary to mount the recording medium P having a long length in a state where the loading portion 16 is suspended in midair. In addition, it is not necessary to replace the wires 102A and 102B. Furthermore, the center of gravity of the recording medium P having a long length on the raising portion 52 and the extension portion 54 becomes close to a central position between the wires 352A and 352B.

Therefore, in the case of the sheet accommodating apparatus 10, a load on the lifting and lowering device 100 is reduced in comparison with a configuration in which a sheet loading surface is extended without being raised.

In addition, in the sheet accommodating apparatus 10, the recording medium P having a long length is loaded onto the raising portion 52 and the extension portion 54 in a length direction. Therefore, in the case of the sheet accommodating apparatus 10, the recording medium P having a long length longer than a recording medium of a normal size is loaded in comparison with a case where a sheet is supported by the loading portion only or the raising portion only. In addition, in the case of the sheet accommodating apparatus 10, the recording medium P having a long length longer than a recording medium of a normal size is loaded in comparison with a case where the extension portion is provided on one end side in a transverse direction of a sheet.

In addition, in the sheet accommodating apparatus 10, the raising portion 52 is disposed on the loading surface 16A of the loading portion 16. Therefore, in the case of the sheet accommodating apparatus 10, attachment of the raising portion 52 is easy in comparison with a case where the raising portion is disposed below the loading portion.

In addition, in the sheet accommodating apparatus 10, the extension portion 54 is fixed to a side of the raising portion 52 and in a case where the loading portion 16 is lifted, the extension portion 54 is integrally lifted with the raising portion 52. Therefore, in the case of the sheet accommodating apparatus 10, attachment of the extension portion 54 is simple in comparison with a case where the extension portion is fixed to a member other than the raising portion beside the raising portion.

In addition, in the sheet accommodating apparatus 10, the lifting and lowering device 100 includes the wires 102A and 102B with which the loading portion 16 is lifted and lowered and the motor 110 that winds up the wires 102A and 102B. In addition, at the time of attachment of the raising portion 52, the wires 102A and 102B are disconnected from the motor 110 such that the loading portion 16 is lowered to the lowermost lowering position due to the weight thereof. Therefore, in the case of the sheet accommodating apparatus 10, attachment of the raising portion 52 is easy in comparison with a configuration in which the loading portion and the wires are not disconnected at the time of attachment of the raising portion.

In addition, in the sheet accommodating apparatus 10, a distance from one end portion on the raising portion 52 side and the other end portion on the extension portion 54 side is larger than the length of the recording medium P having a size of A3 in the longitudinal direction. Therefore, in the case of the sheet accommodating apparatus 10, the recording medium P that is longer than a recording medium having a size of A3 in a longitudinal direction (for example, recording medium P of which length is larger than 488 mm) is able to be loaded.

In addition, in the sheet accommodating apparatus 10, the distance from the one end portion on the raising portion 52 side and the other end portion on the extension portion 54 side is set to such a distance that a terminal of the recording medium P having a length of 864 mm does not stick out. Therefore, in the case of the sheet accommodating apparatus 10, the recording medium P having a length of 864 mm is able to be loaded.

In addition, in the sheet accommodating apparatus 10, air is blown to the recording mediums P loaded onto the raising portion 52 from the air blowing units 44 and the uppermost recording medium P is transported by being sucked by the suction unit 42. Therefore, in the case of the sheet accommodating apparatus 10, multi-feeding of the recording medium P is suppressed in comparison with a case where the uppermost sheet from among sheets loaded onto the raising portion is transported only by means of the paper feeding roller.

In addition, in the image forming system 200, the sheet accommodating apparatus 10 and the image forming apparatus 202 that forms an image on the recording medium P transported from the sheet accommodating apparatus 10 are provided. Therefore, in the case of the image forming system 200, interference between a strength component of the main body portion 12 beside the loading portion 16 and the loading surface 52A for the recording medium P is suppressed in comparison with a configuration in which a sheet loading surface is extended without being raised.

Second Exemplary Embodiment

Next, a sheet accommodating apparatus in a second exemplary embodiment will be described with reference to FIG. 17. Note that, the same components as in the first exemplary embodiment described above are given the same reference numerals and description thereof will be omitted.

Figure 17:
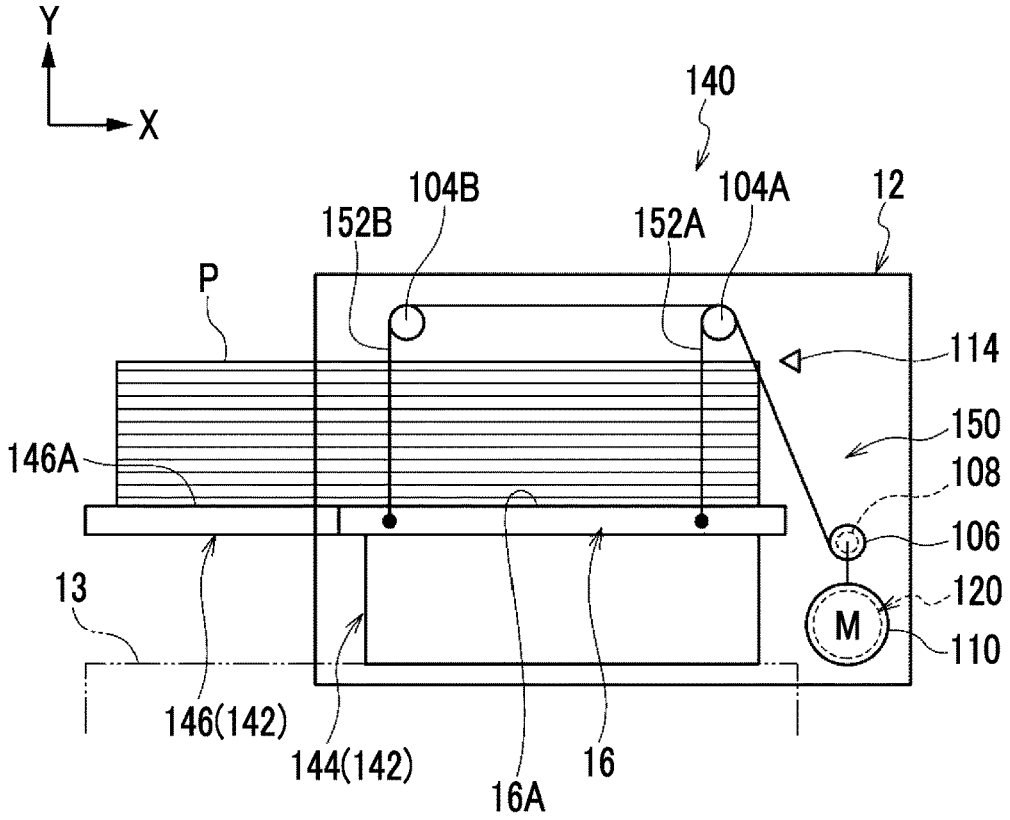
FIG. 17 is a side view showing a lifting and lowering device that lifts and lowers a loading portion, a raising portion, and an extension portion onto which a sheet is loaded in a sheet accommodating apparatus according to a second exemplary embodiment.

As shown in FIG. 17, a sheet accommodating apparatus 140 in the second exemplary embodiment includes a first extension unit 142, which is an example of an extension unit that extends the loading portion 16. The first extension unit 142 includes a raising portion 144 that raises the loading surface for the recording medium P with respect to the lowermost lowering position of the loading portion 16 that can be lifted and an extension portion 146 that extends to a position outward of the loading portion 16 from the raising portion 144 side as seen in plan view. Furthermore, the sheet accommodating apparatus 140 includes a lifting and lowering device 150 which is an example of a lifting and lowering unit that lifts and lowers the loading portion 16.

The raising portion 144 is disposed below the loading portion 16 lifted to a predetermined position by the lifting and lowering device 150. The raising portion 144 is fixed to the frame 13 which is an example of an apparatus main body. The raising portion 144 is not fixed to the loading portion 16 and even in a case where the loading portion 16 is lifted by the lifting and lowering device 150, the raising portion 144 is not lifted.

The extension portion 146 is fixed to a side portion of the loading portion 16 by means of a fastening tool (not shown). The extension portion 146 is integrally lifted and lowered with the loading portion 16 by the lifting and lowering device 150. On an upper surface of the extension portion 146, a loading surface 146A onto which the recording medium P having a long length is loaded is formed.

The recording medium P having a long length, of which the length in the longitudinal direction is longer than the length of a recording medium of a normal size, is loaded onto the loading portion 16 and the extension portion 146. In other words, one end portion side in the longitudinal direction of the recording medium P having a long length is loaded above the raising portion 144. The extension portion 146 supports the other end portion side in the longitudinal direction of the recording medium P having a long length.

The lifting and lowering device 150 includes two wires 152A and 152B that are connected to the loading portion 16 and the pulleys 104A and 104B that are disposed on an upper portion side of the main body portion 12 and on which the wires 152A and 152B are wound respectively. In addition, the lifting and lowering device 150 includes the winding-up pulley 106 with which the two wires 152A and 152B are wound up from the pulleys 104A and 104B. The motor 110 is connected to the winding-up pulley 106 via the coupling mechanism 120.

In the sheet accommodating apparatus 140, the loading portion 16 is lifted to a predetermined height (that is, height at which raising portion 144 can be installed) or higher by the lifting and lowering device 150 and the raising portion 144 is installed on the frame 13. The raising portion 144 may be fixed to the frame 13 by means of a fastening tool (not shown). Then, the loading portion 16 is lowered to a position at which the loading portion 16 comes into contact with the raising portion 144 and the extension portion 146 is attached to the side portion of the loading portion 16 by means of a fastening tool (not shown). In this state, the recording medium P having a long length is loaded onto the loading surface 16A of the loading portion 16 and the loading surface 146A of the extension portion 146.

The sheet accommodating apparatus 140 has the following operation and effect in addition to the operation and effect of the same configuration as the sheet accommodating apparatus 10 in the first exemplary embodiment.

In the sheet accommodating apparatus 140, the raising portion 144 is disposed below the loading portion 16 lifted to a predetermined position by the lifting and lowering device 150. Therefore, in the sheet accommodating apparatus 140, it is possible to the structure of the loading portion 16 onto which the recording medium P is loaded without a change.

In addition, in the sheet accommodating apparatus 140, the raising portion 144 is fixed to the frame 13. Accordingly, the entire mass of the loading portion 16 and the extension portion 146 and the recording mediums P having a long length loaded onto the loading portion 16 and the extension portion 146 is made small. Therefore, in the case of the sheet accommodating apparatus 140, a load on the lifting and lowering device 150 is reduced in comparison with a case where the raising portion is fixed to the loading portion.

Supplementary Description

In the sheet accommodating apparatus 10 in the first exemplary embodiment, the extension portion 54 is fixed to the side portion of the raising portion 52. However, the present invention is not limited to such a configuration. For example, a configuration, in which an extension portion is disposed beside a raising portion and is fixed to an apparatus main body and only the raising portion is lifted with the extension portion being not lifted in a case where the loading portion is lifted, may also be adopted. Accordingly, in a sheet accommodating apparatus, a load on a lifting and lowering unit is suppressed in comparison with a case where the extension portion is integrally lifted with the raising portion in a case where the loading portion is lifted.

In the sheet accommodating apparatus 140 in the second exemplary embodiment, the extension portion 146 is fixed to the side portion of the loading portion 16. However, the present invention is not limited to such a configuration. For example, a configuration, in which an extension portion is disposed beside a loading portion and is fixed to an apparatus main body and only the loading portion is lifted with the extension portion being not lifted in a case where the loading portion is lifted, may also be adopted. Accordingly, in a sheet accommodating apparatus, a load on a lifting and lowering unit is suppressed in comparison with a case where the extension portion is integrally lifted with the loading portion in a case where the loading portion is lifted.

In addition, in the first exemplary embodiment, components of the raising portion 52 and the extension portion 54 and the shapes of the raising portion 52 and the extension portion 54 can be modified.

In the first and second exemplary embodiments, the sheet accommodating apparatus 10 is provided upstream of the image forming apparatus 202 in the transportation direction of the recording medium P and the recording medium P is transported to the image forming apparatus 202 from the sheet accommodating apparatus 10. However, the present disclosure is not limited thereto. For example, a configuration in which the sheet accommodating apparatus is provided downstream of the image forming apparatus in the transportation direction of the recording medium and the recording medium on which an image has been formed by the image forming apparatus is collected by the sheet accommodating apparatus may also be adopted.

In the first and second exemplary embodiments, the recording medium P is used. However, the target of application of the sheet accommodating apparatus in the present disclosure is not limited to a recording medium. The sheet accommodating apparatus in the present disclosure can be applied for any sheet-shaped medium (for example, metal sheet, resin sheet, fabric sheet, or the like) other than a recording medium, for example.

Note that, although a specific exemplary embodiment of the present invention has been described in detail, the present invention is not limited to the exemplary embodiment and it is obvious to persons skilled in the art that other various exemplary embodiments are possible without departing from the scope of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet accommodating apparatus comprising:

a loading portion onto which a sheet is loaded;

a lifting and lowering unit that lifts and lowers the loading portion;

a raising portion that raises a sheet loading surface with respect to a lowermost lowering position of the loading portion and above which a portion of the sheet is loaded; and an extension portion that extends to a position outward of the loading portion from the raising portion side as seen in plan view and supports another portion of the sheet, wherein the sheet is supported by the loading portion or the raising portion and the extension portion, wherein the raising portion is disposed below the loading portion lifted to a predetermined position by the lifting and lowering unit.

2. The sheet accommodating apparatus according to claim 1, wherein the extension portion is provided on one end side in a length direction of the sheet with respect to the loading portion or the raising portion.

3. The sheet accommodating apparatus according to claim 2, wherein the raising portion is disposed on the loading portion.

4. The sheet accommodating apparatus according to claim 3, wherein the extension portion is fixed to a side of the raising portion, and wherein the extension portion is integrally lifted with the raising portion in a case where the loading portion is lifted.

5. The sheet accommodating apparatus according to claim 4, wherein the lifting and lowering unit includes a wire that lifts and lowers the loading portion and a motor that winds up the wire, and wherein the wire and the motor are disconnected from each other at the time of attachment of the raising portion such that the loading portion is lowered to the lowermost lowering position due to a weight thereof.

6. The sheet accommodating apparatus according to claim 3, wherein the extension portion is disposed beside the raising portion and is fixed to an apparatus main body.

7. The sheet accommodating apparatus according to claim 3, wherein the lifting and lowering unit includes a wire that lifts and lowers the loading portion and a motor that winds up the wire, and wherein the wire and the motor are disconnected from each other at the time of attachment of the raising portion such that the loading portion is lowered to the lowermost lowering position due to a weight thereof.

8. The sheet accommodating apparatus according to claim 1, wherein the raising portion is disposed on the loading portion.

9. The sheet accommodating apparatus according to claim 8, wherein the extension portion is fixed to a side of the raising portion, and wherein the extension portion is integrally lifted with the raising portion in a case where the loading portion is lifted.

10. The sheet accommodating apparatus according to claim 9, wherein the lifting and lowering unit includes a wire that lifts and lowers the loading portion and a motor that winds up the wire, and wherein the wire and the motor are disconnected from each other at the time of attachment of the raising portion such that the loading portion is lowered to the lowermost lowering position due to a weight thereof.

11. The sheet accommodating apparatus according to claim 8, wherein the extension portion is disposed beside the raising portion and is fixed to an apparatus main body.

12. The sheet accommodating apparatus according to claim 8, wherein the lifting and lowering unit includes a wire that lifts and lowers the loading portion and a motor that winds up the wire, and wherein the wire and the motor are disconnected from each other at the time of attachment of the raising portion such that the loading portion is lowered to the lowermost lowering position due to a weight thereof.

13. The sheet accommodating apparatus according to claim 1, wherein the raising portion is fixed to an apparatus main body.

14. The sheet accommodating apparatus according to claim 1, wherein a distance from one end portion on the raising portion side and the other end portion on the extension portion side is greater than a length of an A3 sheet in a longitudinal direction.

15. The sheet accommodating apparatus according to claim 14, wherein the distance from the one end portion on the raising portion side and the other end portion on the extension portion side is set to such a distance that a terminal of the sheet having a length of 864 mm does not stick out.

16. The sheet accommodating apparatus according to claim 1, further comprising:

a transportation unit that blows air to the sheet loaded above the raising portion and sucks an uppermost sheet to transport the uppermost sheet.

17. An image forming system comprising:

the sheet accommodating apparatus according to claim 1; and an image forming apparatus that forms an image on the sheet transported from the sheet accommodating apparatus.

18. An extension unit comprising:

a raising portion that is attached to a sheet accommodating apparatus, raises a sheet loading surface with respect to a lowermost lowering position of a liftable and lowerable loading portion, and above which a portion of the sheet is loaded; and an extension portion that extends to a position outward of the loading portion from the raising portion side as seen in plan view and supports another portion of the sheet, wherein the sheet is supported by the loading portion or the raising portion and the extension portion, wherein the raising portion is disposed below the loading portion lifted to a predetermined position by the lifting and lowering unit.

19. A sheet accommodating apparatus comprising:

a loading portion onto which a sheet is loaded;

a lifting and lowering unit that lifts and lowers the loading portion;

a raising portion that raises a sheet loading surface with respect to a lowermost lowering position of the loading portion and above which a portion of the sheet is loaded; and an extension portion that extends to a position outward of the loading portion from the raising portion side as seen in plan view and supports another portion of the sheet, wherein the sheet is supported by the loading portion or the raising portion and the extension portion, wherein the raising portion is disposed on the loading portion, wherein the extension portion is disposed beside the raising portion and is vertically fixed to an apparatus main body.

* * * * *